US012038016B2

(12) United States Patent
Jung et al.

(10) Patent No.: US 12,038,016 B2
(45) Date of Patent: Jul. 16, 2024

(54) BLOWER

(71) Applicant: LG ELECTRONICS INC., Seoul (KR)

(72) Inventors: Jaehyuk Jung, Seoul (KR); Seokho Choi, Seoul (KR); Changhoon Lee, Seoul (KR); Juhyun Kim, Seoul (KR); Hyungho Park, Seoul (KR); Hoojin Kim, Seoul (KR); Yongmin Kim, Seoul (KR); Chiyoung Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 92 days.

(21) Appl. No.: 17/783,385

(22) PCT Filed: Dec. 8, 2020

(86) PCT No.: PCT/KR2020/017875

§ 371 (c)(1),
(2) Date: Jun. 8, 2022

(87) PCT Pub. No.: WO2021/118210

PCT Pub. Date: Jun. 17, 2021

(65) Prior Publication Data

US 2023/0051322 A1 Feb. 16, 2023

(30) Foreign Application Priority Data

Dec. 9, 2019 (KR) ..... 10-2019-0162890
May 29, 2020 (KR) ..... 10-2020-0065091
(Continued)

(51) Int. Cl.
*B63H 1/16* (2006.01)
*F04D 25/06* (2006.01)
(Continued)

(52) U.S. Cl.
CPC ..... *F04D 29/281* (2013.01); *F04D 25/06* (2013.01); *F04D 25/08* (2013.01); *F04D 29/053* (2013.01);
(Continued)

(58) Field of Classification Search
CPC ..... F04D 25/08; F04D 29/281; F04D 29/444; F04D 19/002; F24F 13/20; F24F 8/80
(Continued)

(56) References Cited

U.S. PATENT DOCUMENTS 6,296,446 B1 10/2001 Ishijima et al.
6,554,574 B1 4/2003 Spaggiari
(Continued)

FOREIGN PATENT DOCUMENTS

CN 101099044 1/2008
CN 101405506 4/2009
(Continued)

OTHER PUBLICATIONS

Korean Office Action dated May 17, 2023 issued in Application No. 10-2019-0162890.
(Continued)

*Primary Examiner* — Long T Tran
*Assistant Examiner* — James J Kim
(74) *Attorney, Agent, or Firm* — KED & ASSOCIATES, LLP

(57) ABSTRACT

A blower is provided that includes a lower case having a suction hole through which air flows into the blower; an upper case which is disposed at an upper side of the lower case and which has a discharge port through which the air is discharged from the blower; a fan motor that provides a rotational force; and a fan disposed inside of the lower case and fixed to a motor shaft of the fan motor. The fan includes a hub having an outer surface, which extends at an incline
(Continued)

at a first angle with respect to the motor shaft; a plurality of blades coupled to the hub; and a shroud having an inner surface which extends at an incline, with respect to the motor shaft, at a second angle that is greater than the first angle, and which faces the outer surface of the hub with respect to the plurality of blades, and thus, the air discharged from the fan may change into an ascending current.

20 Claims, 28 Drawing Sheets

(30) Foreign Application Priority Data

Jun. 2, 2020 (KR) ..... 10-2020-0066278
Jun. 2, 2020 (KR) ..... 10-2020-0066279
Jun. 2, 2020 (KR) ..... 10-2020-0066280
Oct. 7, 2020 (KR) ..... 10-2020-0129518

(51) Int. Cl.

| | |
|---|---|
| ***F04D 25/08*** | (2006.01) |
| ***F04D 29/053*** | (2006.01) |
| ***F04D 29/28*** | (2006.01) |
| ***F04D 29/32*** | (2006.01) |
| ***F04D 29/42*** | (2006.01) |
| ***F04D 29/52*** | (2006.01) |
| ***F24F 13/20*** | (2006.01) |
| ***F24F 13/24*** | (2006.01) |

(52) U.S. Cl.
CPC ..... *F04D 29/326* (2013.01); *F04D 29/4226* (2013.01); *F04D 29/522* (2013.01); *F24F 13/20* (2013.01); *F24F 13/24* (2013.01)

(58) Field of Classification Search
USPC ..... 416/182
See application file for complete search history.

(56) References Cited

U.S. PATENT DOCUMENTS

| | | | | |
|---|---|---|---|---|
| 8,152,473 | B2 | 4/2012 | Clemen | |
| 8,317,497 | B2 * | 11/2012 | Finkenbinder | F04D 25/06 415/199.3 |
| 10,550,854 | B2 * | 2/2020 | Lörcher | F04D 29/66 |
| 11,506,220 | B2 * | 11/2022 | Gebert | F04D 29/30 |
| 2004/0253103 | A1 | 12/2004 | Iwase et al. | |
| 2005/0202776 | A1 | 9/2005 | Avedon | |
| 2007/0280829 | A1 | 12/2007 | Stevens | |
| 2009/0155076 | A1 | 6/2009 | Jarrah | |
| 2010/0232971 | A1 | 9/2010 | Chen | |
| 2010/0329871 | A1 * | 12/2010 | Cahill | F04D 29/626 416/187 |
| 2012/0055656 | A1 | 3/2012 | Han et al. | |
| 2013/0323098 | A1 | 12/2013 | Ooya et al. | |
| 2014/0241894 | A1 | 8/2014 | Brownell et al. | |
| 2015/0322964 | A1 | 11/2015 | Fang et al. | |
| 2015/0330223 | A1 | 11/2015 | Choi et al. | |
| 2016/0000967 | A1 | 1/2016 | Pedro et al. | |
| 2016/0052621 | A1 | 2/2016 | Ireland | |
| 2016/0356284 | A1 | 12/2016 | Nakagawa | |
| 2017/0122329 | A1 * | 5/2017 | Son | F04D 29/701 |
| 2017/0248153 | A1 * | 8/2017 | Park | F24F 13/14 |
| 2017/0261000 | A1 | 9/2017 | Komura et al. | |
| 2018/0355884 | A1 | 12/2018 | Sakoda et al. | |

FOREIGN PATENT DOCUMENTS

| | | |
|---|---|---|
| CN | 106958883 | 7/2017 |
| CN | 106969422 | 7/2017 |
| CN | 206877265 | 1/2018 |
| CN | 107850083 | 3/2018 |
| CN | 108105152 | 6/2018 |
| CN | 207761990 | 8/2018 |
| GB | 1141198 | 1/1969 |
| JP | H05-149295 | 6/1993 |
| JP | 2008-240545 | 10/2008 |
| JP | 2010-096084 | 4/2010 |
| JP | 2012-072673 | 4/2012 |
| JP | 2012-255413 | 12/2012 |
| JP | 2013-249763 | 12/2013 |
| JP | 2015-040541 | 3/2015 |
| JP | 2016-000967 | 1/2016 |
| JP | 2016-148342 | 8/2016 |
| KR | 10-2011-0099318 | 9/2011 |
| KR | 10-2013-0033435 | 4/2013 |
| KR | 10-1331487 | 11/2013 |
| KR | 10-1761311 | 7/2017 |
| KR | 10-2017-0107951 | 9/2017 |
| KR | 10-2017-0134707 | 12/2017 |
| KR | 10-2017-0140578 | 12/2017 |
| KR | 10-2018-0125425 | 11/2018 |
| KR | 10-2043068 | 11/2019 |
| KR | 10-2053227 | 12/2019 |
| KR | 10-2058859 | 12/2019 |
| WO | WO 2019 /190169 | 10/2019 |

OTHER PUBLICATIONS

Korean Office Action dated May 17, 2023 issued in Application No. 10-2020-0065091.
International Search Report dated Mar. 16, 2021 issued in Application No. PCT/KR2020/017875.
PCT Search Report issued in Application No. PCT/KR2020/017873 dated Mar. 15, 2021.
Chinese Office Action issued in Application No. 202080085186.9 dated Mar. 11, 2023.
Chinese Office Action issued in Application No. 202080085128.6 dated Mar. 11, 2023.
Korean Office Action issued in Application No. 10-2020-0066278 dated Apr. 6, 2023.
Korean Office Action issued in Application No. 10-2020-0066279 dated Apr. 6, 2023.
Korean Office Action issued in Application No. 10-2020-0066280 dated Apr. 6, 2023.
Korean Office Action issued in Application No. 10-2020-0129518 dated Apr. 6, 2023.
Chinese Office Action dated Sep. 18, 2023 issued in Application No. 202080085128.6.
U.S. Office Action dated Jul. 19, 2023 issued in U.S. Appl. No. 17/783,091.
Extended European Search Report dated Jan. 15, 2024 issued in Application No. 20898981.4.
Extended European Search Report dated Jan. 22, 2024 issued in Application No. 20899247.9.
U.S. Notice of Allowance dated Dec. 22, 2023 issued in U.S. Appl. No. 17/783,091.

* cited by examiner

BLOWER

CROSS-REFERENCE TO RELATED PATENT APPLICATIONS

This application is a U.S. National Stage Application under 35 U.S.C. § 371 of PCT Application No. PCT/KR2020/017875, filed Dec. 8, 2020, which claims priority to Korean Patent Application Nos. 10-2019-0162890, filed Dec. 9, 2019, 10-2020-0065091, filed May 29, 2020, 10-2020-0066279, 10-2020-0066280, 10-2020-0066278, filed Jun. 2, 2020, and 10-2020-0129518, filed Oct. 7, 2020, whose entire disclosures are hereby incorporated by reference.

TECHNICAL FIELD

The present disclosure relates to a blower and, more particularly a fan assembly disposed in a blower.

BACKGROUND ART

A blower circulates air in an interior space or generates airflow toward a user by generating flow of air. When a blower has a filter, the blower can improve the quality of interior air by purifying contaminated air in the interior.

A fan assembly that suctions air and blows the suctioned air to the outside of the blower is disposed in the blower.

The region to which air is discharged from the blower extends in the up-down direction to supply much purified air to an interior space.

However, there is a problem in the related art in that a fan assembly cannot generate uniform rising airflow with respect to air suctioned from under, so purified air is not uniformly supplied to a discharge region extending up and down.

Further, there is a problem in that blower performance is deteriorated and excessive noise is generated due to friction with and flow separation from an internal structure of the blower in the process of generating rising airflow.

A mixed-flow fan that is mounted on an air conditioner has been disclosed in Korean Patent No. 10-2058859, but a way of generating upward airflow through the mixed-flow fan is not provided, so there is a problem in that the up-down length of a discharge region is limited.

A fan assembly that discharges air forward through Coanda effect has been disclosed in Korean Patent No. 10-1331487, but a structure that suppresses vortex generation and flow separation in the process of forming upward airflow is not provided, so there is a problem in that excessive noise is generated.

DISCLOSURE

Technical Problem

An object of the present disclosure is to provide a blower that changes air discharged from a fan into ascending airflow and supplies the ascending airflow to a tower.

Another object of the present disclosure is to provide a blower in which noise is less generated.

Another object of the present disclosure is to provide a blower in which the flow rate of air that is discharged for the fan and is lost is reduced.

Another object of the present disclosure is to provide a blower having a diffuser that guides a flow direction of air discharged from a fan.

Another object of the present disclosure is to provide a blower having a diffuser of which the shape change is minimized.

The objectives of the present disclosure are not limited to the objects described above and other objects will be clearly understood by those skilled in the art from the following description.

Technical Solution

In order to achieve the objects, a blower according to an embodiment of the present disclosure includes: a lower case in which a suction hole through which air flows inside is formed; and an upper case that is disposed on the lower case and in which a discharge hole through which air is discharged is formed.

The blower includes a fan motor that provides rotational force and a fan that is disposed in the lower case and is fixed to a motor shaft of the fan motor, so it is possible to supply inflow air to the upper case.

The fan includes a hub having an outer surface extending to be inclined at a first angle with respect to the motor shaft, a plurality of blades coupled to the hub, and a shroud extending to be inclined at a second angle, which is larger than the first angle, with respect to the motor shaft and having an inner surface facing the outer surface of the hub with the blade therebetween, so it is possible to minimize a loss of flow rate due to the difference of the inclination angles of the hub and the shroud.

The hub may form a hub upper end by extending outward in a radial direction and the shroud may form a shroud edge by extending outward in a radial direction.

The shroud edge may be positioned outside further than the hub upper end in the radial direction, so it is possible to prevent a phenomenon in which air comes out of the shroud.

The shroud may include: a rim portion extending in a circumferential direction; and a supporting portion extending outward in a radial direction from the rim portion.

The rim portion may be positioned outside in a radial direction further than a hub upper portion, so air passing through the rim portion can be guided upward by the hub.

The hub may include: a shaft coupling portion that protrudes up and down at a center of the hub and in which the motor shaft is inserted; a first inclined surface extending outward from the shaft coupling portion; and a second inclined surface extending to be inclined outward from the first inclined surface.

The shaft coupling portion may form a hub lower end by protruding downward from the center of the hub and may form a hub protruding portion by protruding upward.

The shroud edge may be positioned at a height between the hub lower end and the hub protruding portion.

The shroud edge may be positioned at a height between a hub lower end and the first guide surface, so air flowing inside through the shroud can flow upward over the first guide surface.

The shroud may include a rim portion upper end connecting the rim portion and the supporting portion.

The shaft coupling portion may be positioned higher than the rim portion upper end, so air passing through the rim portion can be guided to the first guide surface.

The shroud inclination angle may be formed in a range of 35 degrees to 50 degrees.

An expansion angle may be formed between the hub and the shroud, so air flowing through the shroud can be smoothly pressurized by the blades.

The expansion angle may be formed within a range of 11 degrees and 26 degrees.

A blower according to an embodiment of the present disclosure includes a diffuser that is disposed at a downstream side of the fan and extends in an up-down direction, so it is possible to change the flow direction of air discharged from the fan into ascending airflow.

The diffuser includes a lower end that is concave upward, so air reaching the diffuser can be guided to a diffuser surface over the lower end formed to be concave.

The blower may include: a fan housing in which the fan is accommodated; and a motor housing in which a fan motor applying power to the fan is accommodated.

The diffuser may be disposed between the fan housing and the motor housing, so the diffuser can be supported by the fan housing and the motor housing.

The diffuser may extend to be curved in an up-down direction, so it is possible to have adaptation to a flow direction.

The diffuser may include: a first extending portion extending to be curved downward from an upper end; a second extending portion extending upward from the lower end; and a bending portion connecting the first extending portion and the second extending portion.

At least a portion of the diffuser may be positioned between the hub and the shroud in a radial direction, so air discharged between the hub and the shroud can flow toward the diffuser.

A height of a lower end formed to be concave from an upper side may be formed within a range of 10% to 30% of an entire height of the diffuser, so it is possible to reduce flow friction by a lower edge.

The diffuser may have a plurality of diffuser grooves extending in an up-down direction and spaced apart from each other in an extension direction of the lower end, to air flowing to the diffuser can flow upward.

A rib may be formed between the plurality of diffuser grooves.

A groove lower end of the diffuser groove may be formed to come in contact with a lower end of the diffuser, so air reaching the groove lower end of the diffuser groove can flow upward over the diffuser groove.

A groove upper end of the diffuser groove may be formed to be spaced apart from an upper end of the diffuser, so it is possible to reduce flow friction that is generated at the upper end of the diffuser.

Groove upper ends of the plurality of diffuser grooves may be positioned on the same horizontal surface.

The details of other exemplary embodiments are included in the following detailed description and the accompanying drawings.

Advantageous Effects

According to the blower of the present disclosure, one or more effects can be achieved as follows.

First, since the expansion angle is formed between the hub and the shroud and the diffuser is disposed at a downstream side of the fan, there is an advantage in that it is possible to change the air discharged from the fan into ascending airflow.

Second, since the expansion angle is formed between the hub and the shroud and the lower end of the diffuser is formed in an arc shape, there is also an advantage in that it is possible to reduce noise by decreasing flow friction.

Third, since the expansion angle is formed between the hub and the shroud and the lower end of the diffuser is formed in an arc shape, there is also an advantage in that the air volume performance is improved by reducing a loss of flow rate.

Further, since the lower end of the diffuser is formed in an arc shape and grooves are formed at the diffuser, there is also an advantage in that it is possible to stably form ascending airflow.

Fifth, since only the lower end structure of the diffuser is changed, there is also an advantage in that it is possible to minimize structure deformation.

The effects of the present disclosure are not limited to those described above and other effects not stated herein may be made apparent to those skilled in the art from claims.

MODE FOR INVENTION

Figure 1:
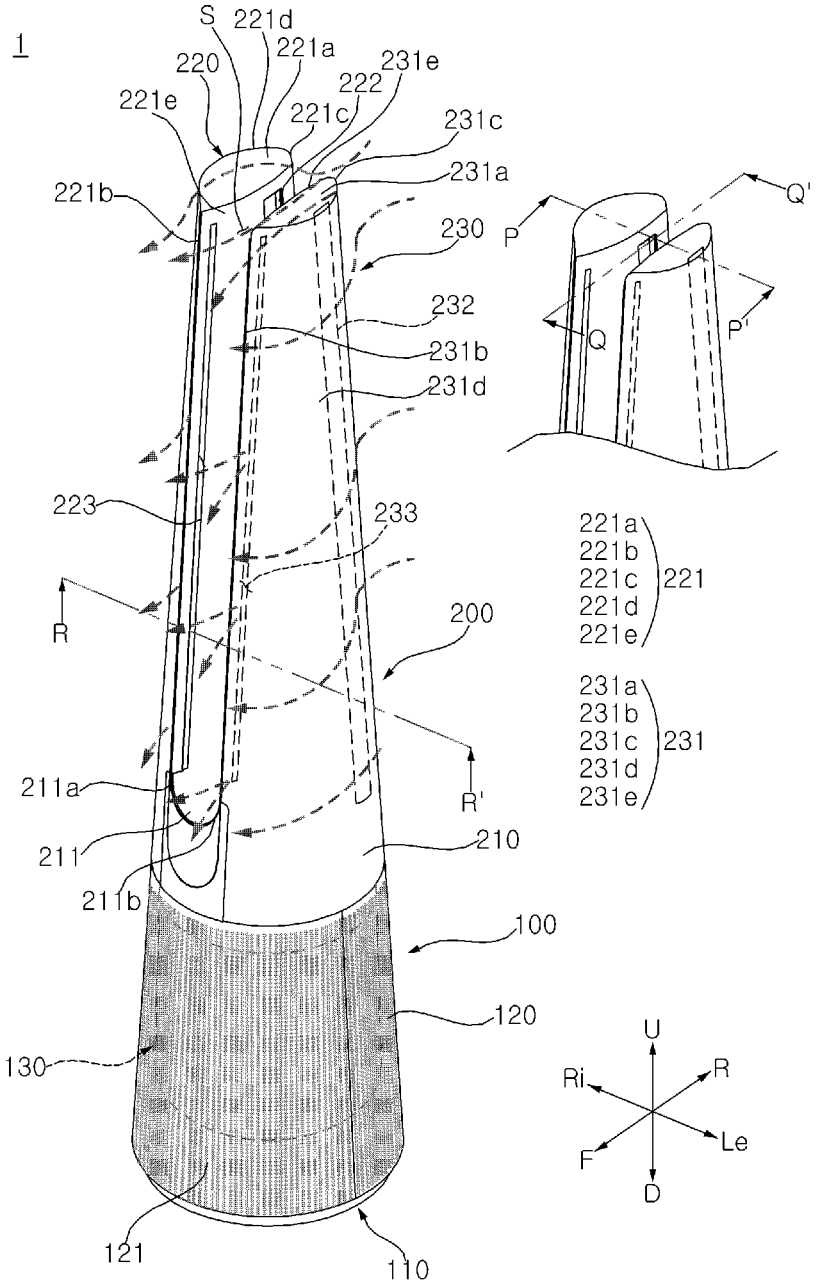
FIG. 1 is a perspective view of a blower according to an embodiment of the present disclosure.

The advantages and features of the present disclosure, and methods of achieving them will be clear by referring to the exemplary embodiments that will be describe hereafter in detail with reference to the accompanying drawings. However, the present disclosure is not limited to the exemplary embodiments described hereafter and may be implemented in various ways, and the exemplary embodiments are provided to complete the description of the present disclosure and let those skilled in the art completely know the scope of the present disclosure and the present disclosure is defined by claims. Like reference numerals indicate like components throughout the specification.

Hereinafter, the present disclosure will be described with reference to the drawings illustrating blowers according to embodiments of the present disclosure.

The entire structure of a blower 1 is described first with reference to FIG. 1. FIG. 1 shows the entire external shape of the blower 1.

The blower 1 may be referred to as another name such as an air conditioner, an air clean fan, air purifier, etc. in that the blower 1 suctions air and circulates the suctioned air.

The blower 1 according to an embodiment of the present disclosure may include a suction module 100 that suctions air and a blowing module 200 that discharges suctioned air.

The blower 1 may have a column shape of which the diameter decreases upward and the entire shape of the blower 1 may be a conical shape or a truncated cone shape. When the cross-section narrows upward, there is an advantage in that the center of gravity lowers and a danger of a fall due to external shock is decreased. However, a shape of which the cross-section does not narrow upward unlike the present embodiment is possible.

The suction module 100 may be formed such that the diameter gradually decreases upward and the blowing module 200 may also be formed such that the diameter gradually decreases upward.

The suction module 100 may include a base 110, a lower case 120 disposed on the base 110, and a filter 130 disposed in the lower case 120.

The base 110 may be seated on the ground and can support load of the blower 1. The lower case 120 and the filter 130 may be seated on the base 110.

The lower case 120 may have a cylindrical external shape and may form a space in which the filter 130 is disposed therein. A suction hole 121 that open to the inside of the lower case 120 may be formed at the lower case 120. A plurality of suction holes 121 may be formed along the edge of the lower case 120.

The filter 130 may have a cylindrical external shape and can filter out foreign substance contained in the air suctioned through the suction hole 121.

The blowing module 200 may be separated and disposed into two column shapes extending up and down. The blower module 200 may include a first tower 220 and a second tower 230 that are disposed to be spaced apart from each other. The blowing module 200 may include a tower base 210 connecting the first tower 220 and the second tower 230 with the suction module 100. The tower base 210 may be disposed on the suction module 100 and may be disposed under the first tower 220 and the second tower 230.

The tower base 210 may have a cylindrical external shape and may form a continuous outer circumferential surface with the suction module 100 by being disposed on the suction module 100.

The upper surface of the tower base 210 may be formed to be concave downward and may form a tower base upper surface 211 extending forward and rearward. The first tower 220 may extend upward from a side 211*a* of the tower base upper surface 211 and the second tower 230 may extend upward from another side 211*b* of the tower base upper surface 211.

The tower base 210 may distribute filtered air supplied from the inside of the suction module 100 and may provide the distributed air to the first tower 220 and the second tower 230.

The tower base 210, the first tower 220, and the second tower 230 each may be manufactured as a separate part and may be manufactured in an integrated type. The tower base 210 and the first tower 220 may form a continuous external circumferential surface of the blower 1, and the tower base 210 and the second tower 230 may form the continuous external circumferential surface of the blower 1.

Unlike the present disclosure, the first tower 220 and the second tower 230 may be assembly directly to the suction module 100 without the tower base 210 and may be integrally manufactured with the suction module 100.

The first tower 220 and the second tower 230 may be disposed to be spaced apart from each other and a blowing space S may be formed between the first tower 220 and the second tower 230.

The blowing space S may be understood as a space being open on the front, the rear, and the top between the first tower 220 and the second tower 230.

The external shape of the blowing module 200 composed of the first tower 220, the second tower 230, and the blowing space S may be a truncated cone shape.

Discharge holes 222 and 232 formed at the first tower 220 and the second tower 230, respectively, may discharge air toward the blowing space S. When the discharge holes 222 and 232 need to be discriminated, the discharge hole formed at the first tower 220 is referred to as a first discharge hole 222 and the discharge hole formed at the second tower 230 is referred to as a second discharge hole 232.

The first tower 220 and the second tower 230 may be symmetrically discharged with the blowing space S therebetween. Since the first tower 220 and the second tower 230 are symmetrically discharged, flow is uniformly distributed in the blowing space S, so it is more advantageous in control of horizontal airflow and ascending airflow.

The first tower 220 may include a first tower case 221 forming the external shape of the first tower 220 and the second tower 230 may include a second tower case 231 forming the external shape of the second tower 230. The first tower case 221 and the second tower case 231 may be referred to as upper cases that are disposed on the lower case 120 and have the discharge holes 222 and 232 discharging air, respectively.

The first discharge hole 222 may be formed at the first tower 220 to extend in the up-down direction and the second discharge hole 232 may be formed at the second tower 230 to extend up and down.

The flow direction of air discharged from the first tower 220 and the second tower 230 may be formed in the front-rear direction.

The width of the blowing space S that is the gap between the first tower 220 and the second tower 230 may be formed to be the same in the up-down direction. However, the upper end width of the blowing space S may be formed to be narrower or wider than the lower end width.

By uniformly forming the width of the blowing space S in the up-down direction, it is possible to uniformly distribute the air, which flows to the front of the blowing space S, in the up-down direction.

When the width of the upper side and the width of the lower side are different, the flow speed at the wide side may be low and a different of a speed may be generated in the up-down direction. When a flow different of air is generated in the up-down direction, the supply amount of clean air may be changed in accordance with the position in the up-down direction.

Air discharged from each of the first discharge hole 222 and the second discharge hole 232 may join in the blowing space S and then may be supplied to a user.

Air discharged from the first discharge hole 222 and air discharged from the second discharge hole 232 may join in the blowing space S and then supplied to a user without separately flowing to the user.

The blowing space S may be used as a space in which discharged air is joined and mixed. Indirect airflow is generated in the air around the blower 1 by the discharged air that is discharged to the blowing space S, so the air around the blower 1 may flow toward the blowing space S.

As the discharged air of the first discharge hole 222 and the discharged air of the second discharge hole 232 join in the blowing space S, straightness of discharged air can be improved. As the discharged air of the first discharge hole 222 and the discharged air of the second discharge hole 232 join in the blowing space S, the air around the first tower 220 and the second tower 230 may also be induced to flow forward long the outer circumferential surface of the blowing module 200 by the indirect airflow.

The first tower case 221 may include: a first tower upper end 221*a* forming the upper surface of the first tower 220; a first tower front end 221*b* forming the front surface of the first tower 220; a first tower rear end 221*c* forming the rear surface of the first tower 220; a first outer wall 221*d* forming the outer circumferential surface of the first tower 220, and a first inner wall 221*e* forming the inner surface of the first tower 220.

The second tower case 231 may include: a second tower upper end 231*a* forming the upper surface of the second tower 231; a second tower front end 231*b* forming the front surface of the second tower 231; a second tower rear end 231*c* forming the rear surface of the second tower 231; a second outer wall 231*d* forming the outer circumferential surface of the second tower 231, and a second inner wall 231*e* forming the inner surface of the second tower 231.

The first outer wall 221*d* and the second outer wall 231*d* are formed to be convex outward in the radial direction, so they may form the outer circumferential surfaces of the first discharge hole 222 and the second discharge hole 232, respectively.

The first inner wall 221*e* and the second inner wall 231*e* are formed to be convex inward in the radial direction, so they may form the inner circumferential surfaces of the first discharge hole 222 and the second discharge hole 232, respectively.

The first discharge hole 222 may be formed in the first inner wall 221*e* to extend in the up-down direction and may be formed to be open inward in the radial direction. The second discharge hole 232 may be formed in the second inner wall 231*e* to extend in the up-down direction and may be formed to be open inward in the radial direction.

The first discharge hole 222 may be formed at a position closer to the first tower rear end 221*c* of the first tower front end 221*b*. The second discharge hole 232 may be formed at a position closer to the second tower rear end 231*c* of the second tower front end 231*b*.

A first board slot 223 that a first airflow shifter 320 that will be described below passes through may be formed in the first inner wall 221*e* to extend in the up-down direction. A second board slot 233 that a second airflow shifter 330 that will be described below passes through may be formed in the second inner wall 231*e* to extend in the up-down direction. The first board slot 223 and the second board slot 233 may be formed to be open inward in the radial direction.

The first board slot 223 may be formed at a position closer to the first tower front end 221*b* of the first tower rear end 221*c*. The second board slot 233 may be formed at a position closer to the second tower front end 231*b* of the second tower rear end 231*c*. The first board slot 223 and the second board slot 233 may be formed to face each other.

Figure 2:
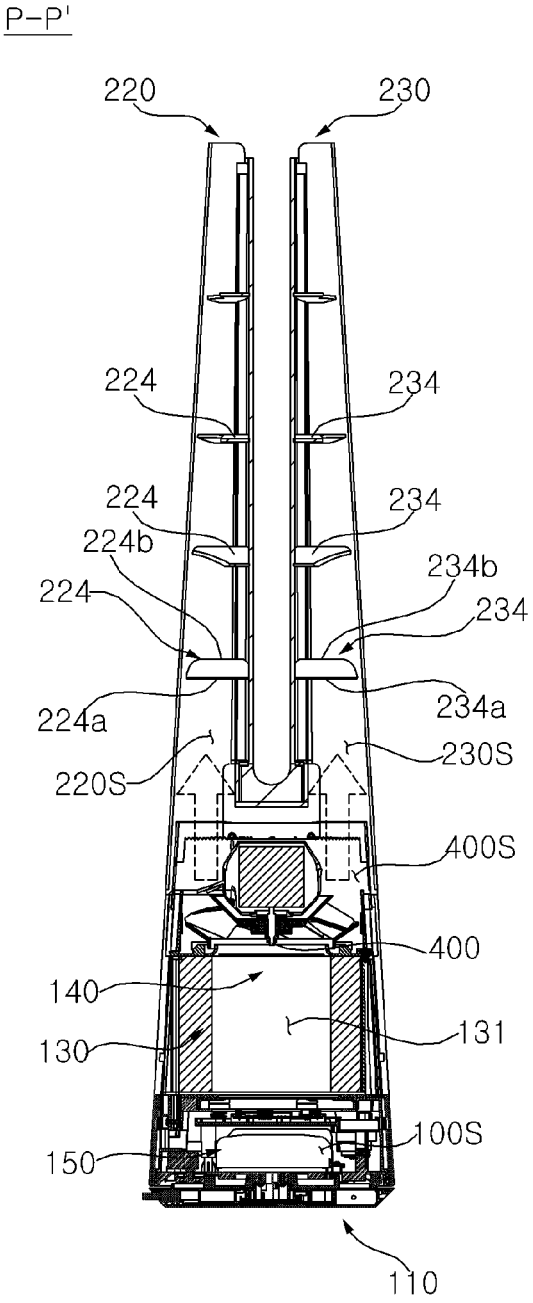
FIG. 2 is a vertical cross-sectional projection view of the blower according to an embodiment of the present disclosure.
Figure 3:
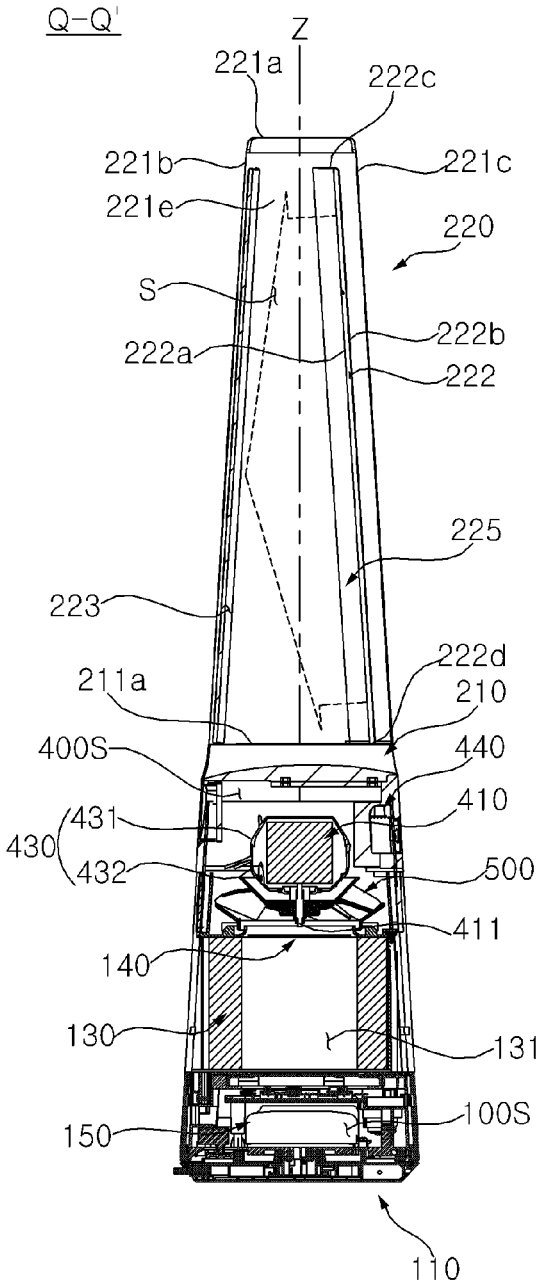
FIG. 3 is another vertical cross-sectional projection view of a blower according to an embodiment of the present disclosure.

Hereafter, the internal structure of the blower 1 is described with reference to FIGS. 2 and 3. FIG. 2 is a cross-sectional projection view cutting the blower 1 along line P-P' shown in FIG. 1 and FIG. 3 is a cross-sectional projection view cutting the blower 1 along line Q-Q' shown in FIG. 1.

Referring to FIG. 2, a driving module 150 that rotates the blower 1 in the circumferential direction may be disposed on the base 110. A driving space 100S in which the driving module 150 is disposed may be formed on the base 110.

The filter 130 may be disposed on the driving space 100S. The external shape of the filter 130 may be a cylindrical shape and a cylindrical filter hole 131 may be formed in the filter 130.

Air suctioned inside through the suction hole 121 may flow to the filter hole 131 through the filter 130.

A suction grill 140 that air, which passes through the filter 130 and flows upward, passes through may be disposed on the filter 130. The suction grill 140 may be disposed between a fan assembly 400 that will be described below and the filter 130. The suction grill 140 may prevent a user's hand from being put into the fan assembly 400 when the lower case 210 is removed and the filter 130 is separated from the blower 1.

The fan assembly 400 may be disposed on the filter 130 and may generate a suction force for air outside the blower 1.

By driving of the fan assembly 400, the air outside the blower 1 may sequentially pass through the suction hole 121 and the filter hole 131 and flow to the first tower 220 and the second tower 230.

A pressurizing space 400*s* in which the fan assembly 400 is disposed may be formed between the filter 130 and the blowing module 200.

A first distribution space 220*s* in which air passing through the pressurizing space 400*s* flows upward may be formed in the first tower 220, and a second distribution space 230*s* in which air passing through the pressurizing space 400*s* flows upward may be formed in the second tower 230. The tower base 210 may distribute air passing through the pressurizing space 400*s* to a first distribution space 220*s* and a second distribution space 230*s*. The tower base 210 may be a channel connecting the first and second towers 220 and 230 and the fan assembly 400.

The first distribution space 220*s* may be formed between the first outer wall 221*d* and the first inner wall 221*e*. The second distribution space 230*s* may be formed between the second outer wall 231*d* and the second inner wall 231*e*.

The first tower 220 may include a first flow guide 224 that guides a flow direction of air in the first distribution space 220*s*. A plurality of first flow guides 224 may be disposed to be spaced part from each other up and down.

The first flow guide 224 may be formed to protrude toward the first tower front end 221*b* from the first tower rear end 221*c*. The first flow guide 224 may be spaced apart from the first tower front end 221*b* in the front-read direction. The first flow guide 224 may extend to be inclined downward toward the front. A first guide front end 224*a* forming the front surface of the first flow guide 224 may be positioned lower than a first guide rear end 224*b* forming the rear surface of the first flow guide 224. The downwardly inclined angles of first flow guides disposed at the upper portion of a plurality of first flow guides 224 may be smaller.

The second tower 230 may include a second flow guide 234 that guides a flow direction of air in the second distribution space 230*s*. A plurality of second flow guides 234 may be disposed to be spaced part from each other up and down.

The second flow guide 234 may be formed to protrude toward the second tower front end 231*b* from the second tower rear end 231*c*. The second flow guide 234 may be spaced apart from the second tower front end 231*b* in the front-read direction. The second flow guide 234 may extend to be inclined downward toward the front. A second guide front end 234*a* forming the front surface of the second flow guide 234 may be positioned lower than a second guide rear end 234*b* forming the rear surface of the second flow guide 234. The downwardly inclined angles of second flow guides disposed at the upper portion of a plurality of second flow guides 234 may be smaller.

The first flow guide 224 may guide air discharged from the fan assembly 400 to flow toward the first discharge hole 222. The second flow guide 234 may guide air discharged from the fan assembly 400 to flow toward the second discharge hole 232.

Referring to FIG. 3, the fan assembly 400 may include: a fan motor 410 that generates power; a motor housing 430 in which the fan motor 410 is accommodated; a fan 500 that is rotated by receiving power from the fan motor 410; and a diffuser 440 that guides the flow direction of air pressurized by the fan 500.

The fan motor 410 may be disposed on the fan 500 and may be connected with the fan 500 through a motor shaft 411 extending downward from the fan motor 410.

The motor housing 430 may include a first motor housing 431 covering the upper portion of the fan motor 410 and a second motor housing 432 covering the lower portion of the fan motor 410.

The first discharge hole 222 may extend upward from a side 211*a* of the tower base upper surface 211. A first discharge hole lower end 222*d* may be formed at the side 211*a* of the tower base upper surface 211.

The first discharge hole 222 may be formed to be spaced under the first tower upper end 221*a*. A first discharge hole upper end 222*c* may be formed to be spaced under the first tower upper end 221*a*.

The first discharge hole 222 may extend to be inclined in the up-down direction. The first discharge hole 222 may extend to be inclined forward toward the upper portion. The first discharge hole 222 may extend to be inclined rearward with respect to an up-down axis Z extending in the up-down direction.

The first discharge hole front end 222*a* and the first discharge hole rear end 222*b* may extend to be inclined in the up-down direction and may extend in parallel with each other. The first discharge hole front end 222*a* and the first discharge hole rear end 222*b* may extend to be inclined rearward with respect to the up-down axis Z extending in the up-down direction.

The first tower 220 may include a first discharge guide 225 that guides air in the first distribution space 220*s* to the first discharge hole 222.

The first tower 220 may be symmetric to the second tower 230 with the blowing space S therebetween and may have the same shape and structure as the second tower 230. The above description of the first tower 220 may be applied to the second tower 230 in the same way.

Figure 4:
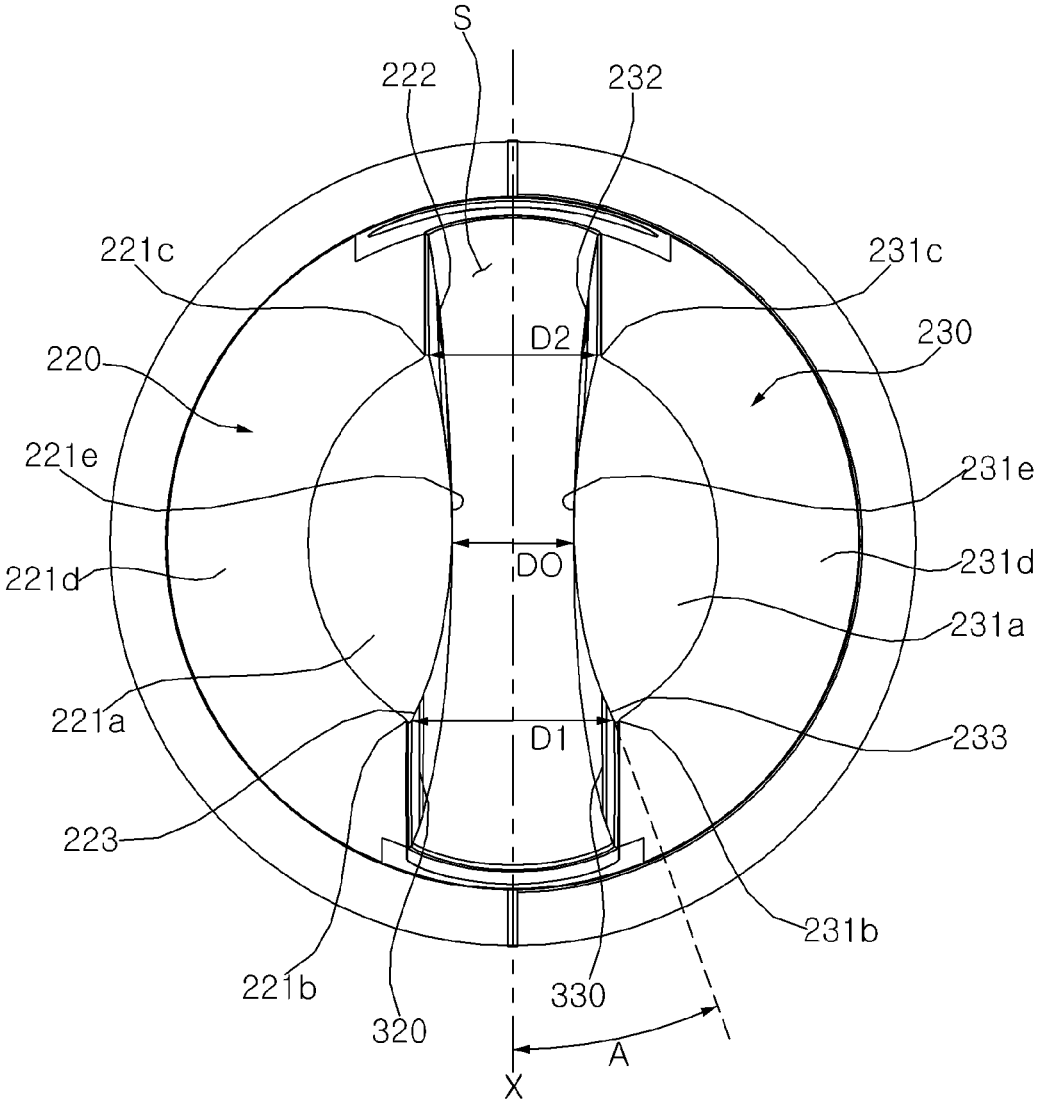
FIG. 4 is a top projection view of the blower according to an embodiment of the present disclosure.
Figure 5:
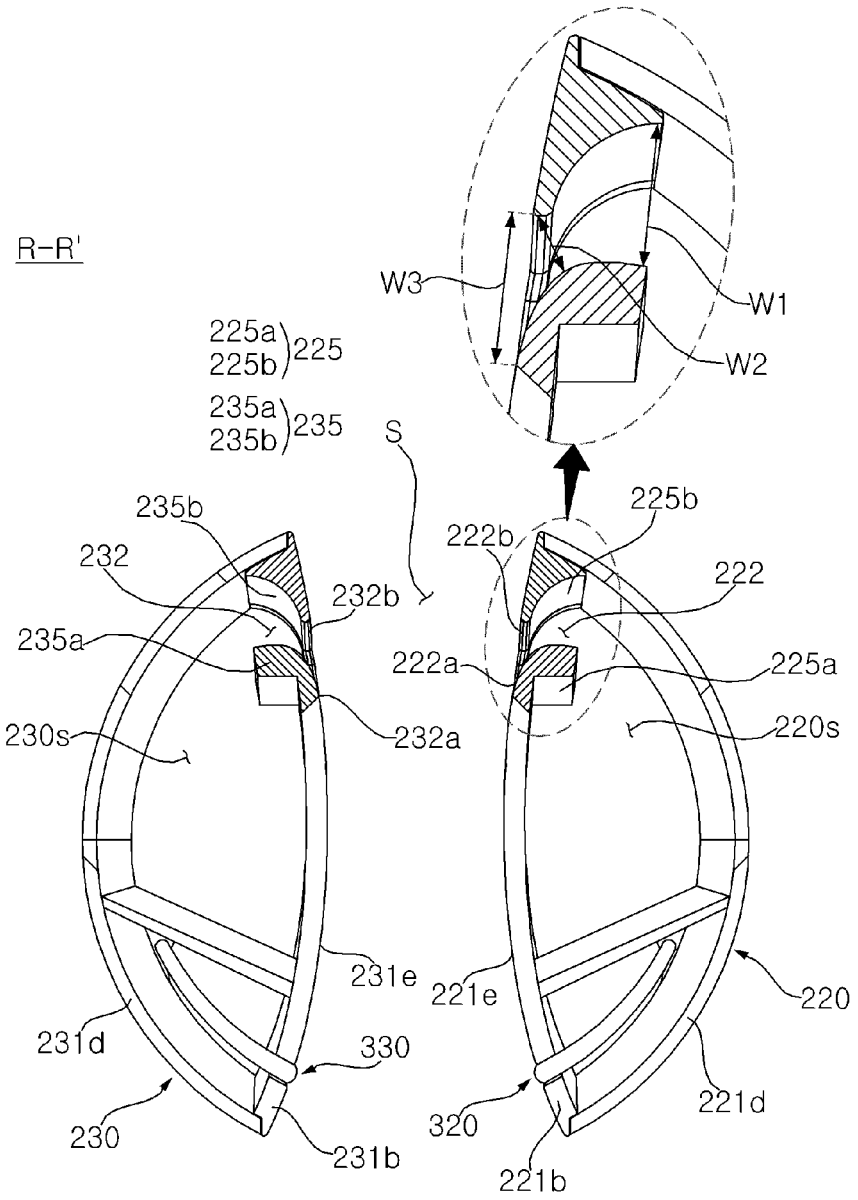
FIG. 5 is a horizontal cross-sectional projection view of the blower according to an embodiment of the present disclosure.

Hereafter, an air discharge structure of the blower 1 for inducing Coanda effect is described with reference to FIGS. 4 and 5. FIG. 4 is a projection view showing the blower 1 in the right downward direction from above and FIG. 5 is a projection view showing the blower 1 cut along line R-R' shown in FIG. 1 in the upward direction.

Referring to FIG. 4, gaps D0, D1, and D2 between the first inner wall 221*e* and the second rear wall 231*e* may become smaller as they are close to the center of the blowing space S.

The first inner wall 221*e* and the second inner wall 231*e* may be formed to be convex inward in the radial direction, and the shortest distance D0 may be formed between the apexes of the first inner wall 221*e* and the second inner wall 231*e*. The shortest distance D0 may be formed at the center of the blowing space S.

The first discharge hole 222 may be formed behind the position where the shortest distance D0 is formed. The second discharge hole 232 may be formed behind the position where the shortest distance D0 is formed.

The first tower front end 221*b* and the second tower front end 231*b* may be spaced apart from each other by a first gap D1. The first tower rear end 221*c* and the second tower rear end 231*c* may be spaced apart from each other by a second gap D2.

The first gap D1 and the second gap D2 may be the same. The first gap D1 may be larger than the shortest distance D0 and the second gap D2 may be larger than the shortest distance D0.

The gap between the first inner wall 221*e* and the second inner wall 231*e* may decrease from the rear ends 221*c* and 231*c* to the position where the shortest distance D0 is formed and may increase from the position where the shortest distance D0 is formed to the front ends 221*b* and 231*b*.

The first tower front end 221*b* and the second tower front end 231*b* may be formed to be inclined with respect to a front-rear axis X.

Tangent lines extending from the first tower front end 221*b* and the second tower front end 231*b* each may have a predetermined inclination angle A with respect to the front-rear axis X.

A portion of the air discharged forward through the blowing space S may flow with the inclination angle A with respect to the front-rear axis X.

By the structure described above, a diffusion angle of air discharged forward through the blowing space S may increase.

The first airflow shifter 320 that will be described below may be inserted in the first board slit 223 when air is discharged forward from the blowing space S.

The second airflow shifter 330 that will be described below may be inserted in the second board slit 233 when air is discharged forward from the blowing space S.

Referring to FIG. 5, the flow direction of the air discharged toward the blowing space S may be guided by the first discharge guide 225 and the second discharge guide 235.

The first discharge guide 225 may include a first inner guide 225*a* connected with the first inner wall 221*e* and a first outer guide 225*b* connected with the first outer wall 221*d*.

The first inner guide 225*a* may be manufactured integrally with the first inner wall 221*e*, but may be manufactured as a separate part.

The first outer guide 225*b* may be manufactured integrally with the first outer wall 221*d*, but may be manufactured as a separate part.

The first inner guide 225*a* may be formed to protrude toward the first distribution space 220*s* from the first inner wall 221*e*.

The first outer guide 225*b* may be formed to protrude toward the first distribution space 220*s* from the first outer wall 221*d*. The first outer guide 225*b* may be formed to be spaced outside the first inner guide 225*a*, and may form the first discharge hole 222 between the first outer guide 225*b* and the first inner guide 225*a*.

The radius of curvature of the first inner guide 225*a* may be formed to be smaller than the radius of curvature of the first outer guide 225*b*.

Air of the first distribution space 220*s* may flow between the first inner guide 225*a* and the first outer guide 225*b* and flow to the blowing space S through the first discharge hole 222.

The second discharge guide 235 may include a second inner guide 235*a* connected with the second inner wall 231*e* and a second outer guide 235*b* connected with the second outer wall 231*d*.

The second inner guide 235*a* may be manufactured integrally with the second inner wall 231*e*, but may be manufactured as a separate part.

The second outer guide 235*b* may be manufactured integrally with the second outer wall 231*d*, but may be manufactured as a separate part.

The second inner guide 235*a* may be formed to protrude toward the second distribution space 230*s* from the second inner wall 231*e*.

The second outer guide 235*b* may be formed to protrude toward the second distribution space 230*s* from the second outer wall 231*d*. The second outer guide 235*b* may be formed to be spaced outside the second inner guide 235*a*, and may form the second discharge hole 232 between the second outer guide 235*b* and the second inner guide 235*a*.

The radius of curvature of the second inner guide 235*a* may be formed to be smaller than the radius of curvature of the second outer guide 235*b*.

Air of the second distribution space 230*s* may flow between the second inner guide 235*a* and the second outer guide 235*b* and flow to the blowing space S through the second discharge hole 232.

Widths w1, w2, and w3 of the first discharge hole 222 may be formed to gradually decrease toward the outlet from the inlet of the first discharge guide 225 and then increase.

The size of the inlet width w1 of the first discharge guide 225 may be larger than the outlet width w3 of the first discharge guide 225.

The inlet width w1 may be defined as the gap between an outer end of the first inner guide 225*a* and an outer end of the first outer guide 225*b*. The outlet width w3 may be defined as the gap between the first discharge hole front end 222*a* that is an inner end of the first inner guide 225*a* and the first discharge hole rear end 222*b* that is an inner end of the first outer guide 225*b*.

The sizes of the inlet width w1 and the outlet width w3 may be larger than the size of a shortest width w2 of the first discharge hole 222.

The shortest width w2 may be defined as the shortest distance between the first discharge hole rear end 222*b* and the first inner guide 225*a*.

The widths of the first discharge hole 222 may gradually decrease from the inlet of the first discharge guide 225 to the position where the shortest width w2 is formed and may gradually increase from the position where the shortest width w2 is formed to the outlet of the first discharge guide 225.

The second discharge guide 235, similar to the first discharge guide 225, may also have a second discharge hole front end 232*a* and a second discharge hole rear end 232*b* and may have distribution of width the same as the first discharge guide 225.

Figure 6:
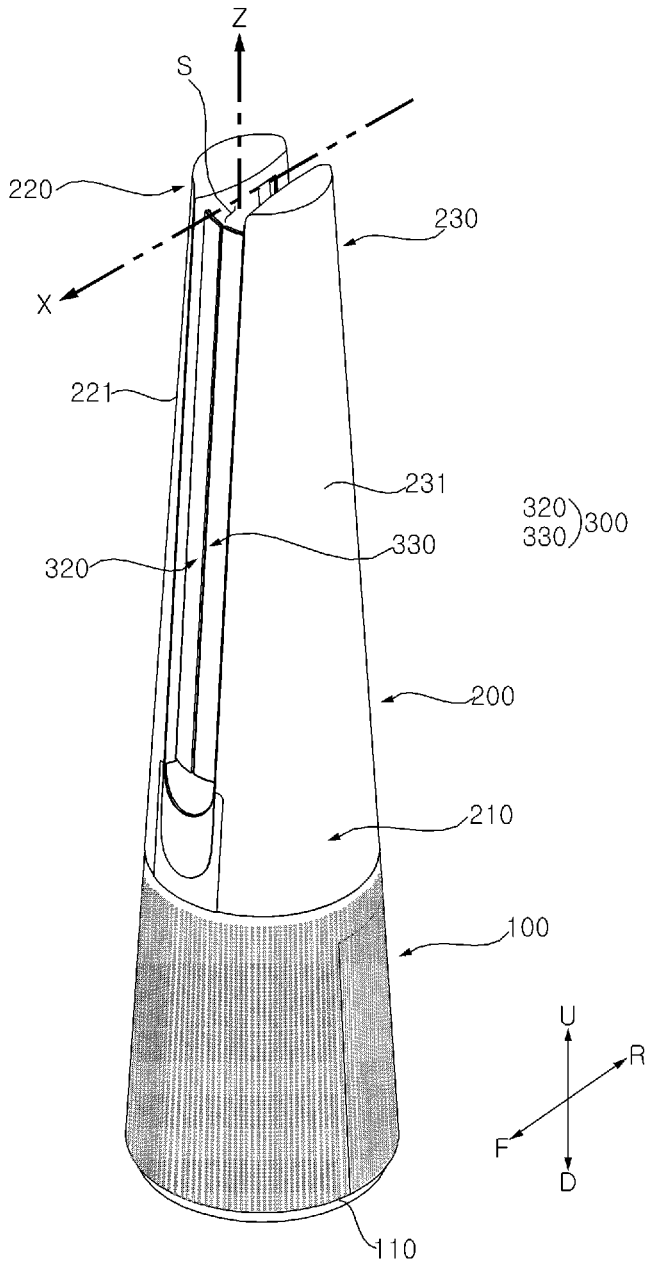
FIG. 6 is a perspective view of the blower with an airflow shifter according to an embodiment of the present disclosure.
Figure 7:
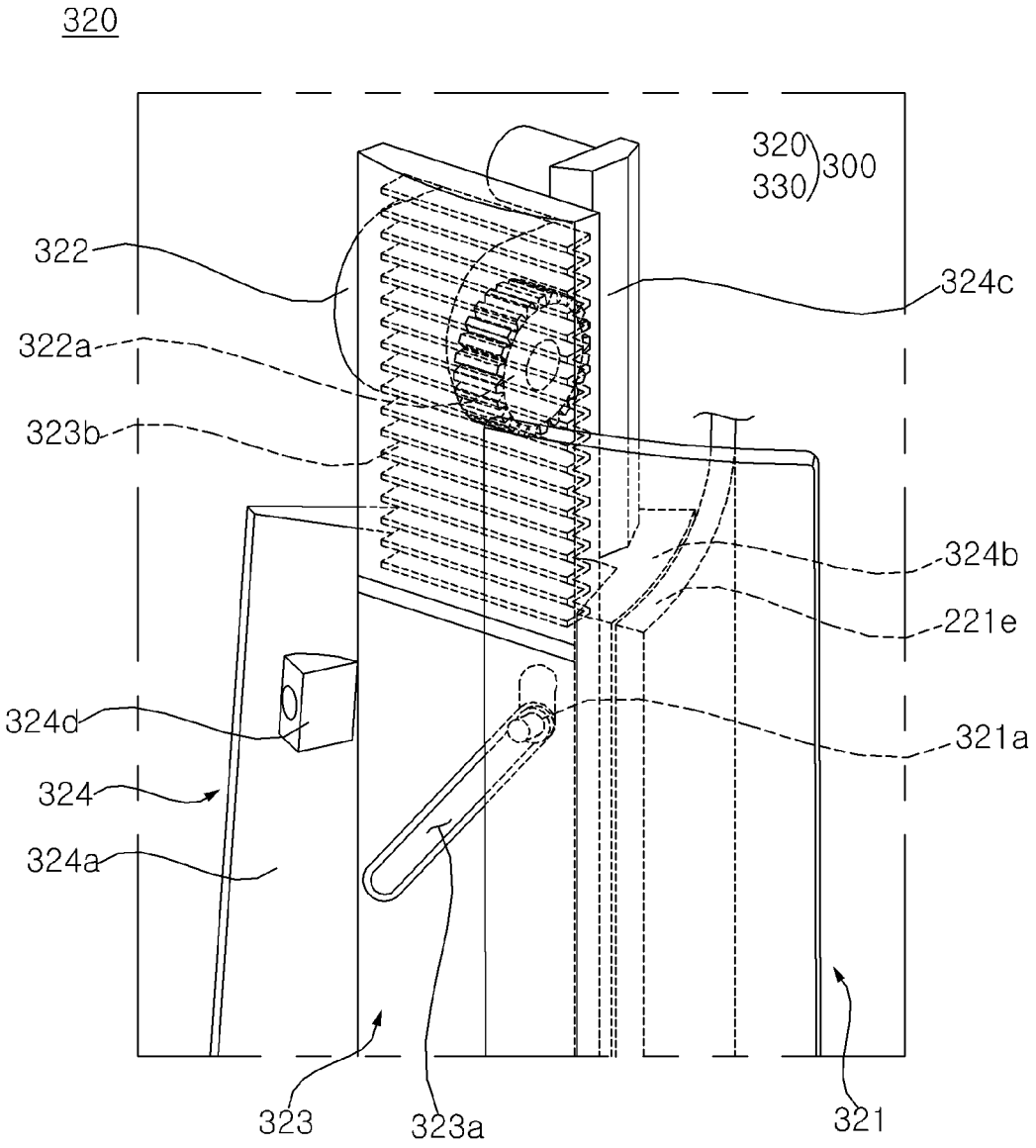
FIG. 7 is a projection view of the airflow shifter according to an embodiment of the present disclosure.

Hereafter, an air direction change by an airflow shifter 300 is described with reference to FIGS. 6 and 7. FIG. 6 is a view showing the case in which the airflow shifter 300 protrudes to the blowing space S and the blower 1 forms ascending airflow and FIG. 7 is a view showing the operation principle of the airflow shifter 300.

Referring to FIG. 6, the airflow shifter 300 may protrude toward the blowing space S and may change the flow of air, which is discharged forward through the blowing space S, into ascending air.

The airflow shifter 300 may include a first airflow shifter 320 disposed in the first tower case 221 and a second airflow shifter 330 disposed in the second tower case 231.

The first airflow shifter 320 and the second airflow shifter 330 may block the front of the blowing space S by protruding from the blowing space S from the first tower 220 and the second tower 230, respectively.

When the first airflow shifter 320 and the second airflow shifter 330 protrude and block the front of the blowing space S, air discharged through the first discharge hole 222 and the second discharge hole 232 is blocked by the airflow shifter 330, so the air may flow upward Z.

When the first discharge hole 222 and the second discharge hole 232 are inserted into the first tower 220 and the second tower 230, respectively, and open the front of the blowing space S, air discharged through the first discharge hole 222 and the second discharge hole 232 may flow forward X through the blowing space S.

Referring to FIG. 7, the airflow shifters 320 and 330 may include: a board 321 protruding toward the blowing space; a motor 322 providing a driving force to the board 321; a board guide 323 guiding a movement direction of the board 321; and a cover 324 supporting the motor 322 and the board guide 323.

The first airflow shifter 320 is exemplified in the following description, but the following description of the first airflow shifter 320 may also be applied to the second airflow shifter 330 in the same way.

The board 321, as shown in FIGS. 4 and 5, may be inserted in the first board slit 223. The board 321 may protrude to the blowing space S through the first board slit 223 when the motor 322 is driven. The board 321 may have an arch shape of which the shape of a transverse cross-section is an arc shape. The board 321 may move in the circumferential direction and protrude to the blowing space S when the motor 322 is driven.

The motor 322 may be connected with a pinion gear 322*a* and may rotate the pinion gear 322*a*. The motor 322 may rotate the pinion gear 322*a* clockwise and counterclockwise.

The board guide 323 may have a plate shape extending up and down. The board guide 323 may include a guide slit 323*a* extending to be inclined up and down and a rack 323*b* formed to protrude toward the pinion gear 322*a*.

The rack 323*b* may be engaged with the pinion gear 322*a*. When the motor 322 is driven and the pinion gear 322*a* is rotated, the rack 323*b* engaged with the pinion gear 322*a* may be moved up and down.

A guide protrusion 321*a* formed at the board 321 to protrude toward the board guide 323 may be inserted in the guide slit 323*a*.

When the board guide 323 is moved up and down in accordance with up/down movement of the rack 323*b*, the guide protrusion 321*a* may be moved by force from the guide slit 323*a*. As the board guide 323 is moved up and down, the guide protrusion 321*a* may be diagonally moved in the guide slit 323*a*.

When the rack 323*b* is moved up, the guide protrusion 321*a* may be moved along the guide slit 323*a* and may be positioned at the lowermost end of the guide slit 323*a*. When the guide protrusion 321*a* is positioned at the lowermost end of the guide slit 323*a*, the board 321, as shown in FIGS. 4 and 5, may be completely hidden in the first tower 220. When the rack 323*b* is moved up, the guide slit 323*a* is also moved up, so the guide protrusion 321*a* may be moved in the circumferential direction o the same horizontal surface along the guide slit 323*a*.

When the rack 323*b* is moved down, the guide protrusion 321*a* may be moved along the guide slit 323*a* and may be positioned at the uppermost end of the guide slit 323*a*. When the guide protrusion 321*a* is positioned at the uppermost end of the guide slit 323*a*, the board 321, as shown in FIG. 6, may protrude toward the blowing space S from the first tower 220. When the rack 323*b* is moved down, the guide slit 323*a* is also moved down, so the guide protrusion 321*a* may be moved in the circumferential direction o the same horizontal surface along the guide slit 323*a*.

The cover 324 may include: a first cover 324*a* disposed outside the board guide 323; a second cover 324*b* disposed inside the board guide 323 and being in close contact with the first inner surface 221*e*; a motor support plate 324*c* extending upward from the first cover 324*a* and connected with the motor 322; and a stopper 324*b* restricting up/down movement of the board guide 323.

The first cover 324*a* may cover the outer side of the board guide 323 and the second cover 324*b* may cover the inner side of the board guide 323. The first cover 324*a* may separate the space in which the board guide 323 is disposed from the first distribution space 220*s*. The second cover 324*b* may prevent the board guide 323 from coming in contact with the first inner wall 221*e*.

The motor support plate 324*c* may extend upward from the first cover 324*a* and support load of the motor 322.

The stopper 324*d* may be formed to protrude toward the board guide 323 from the first cover 324*a*. A locking protrusion (not shown) that is locked to the stopper 324*d* in accordance with up/down movement may be formed on one surface of the board guide 323. When the board guide 323 is moved up and down, the locking protrusion (not shown) is locked to the stopper 324*d*, so the up/down movement of the board guide 323 may be restricted.

Figure 8:
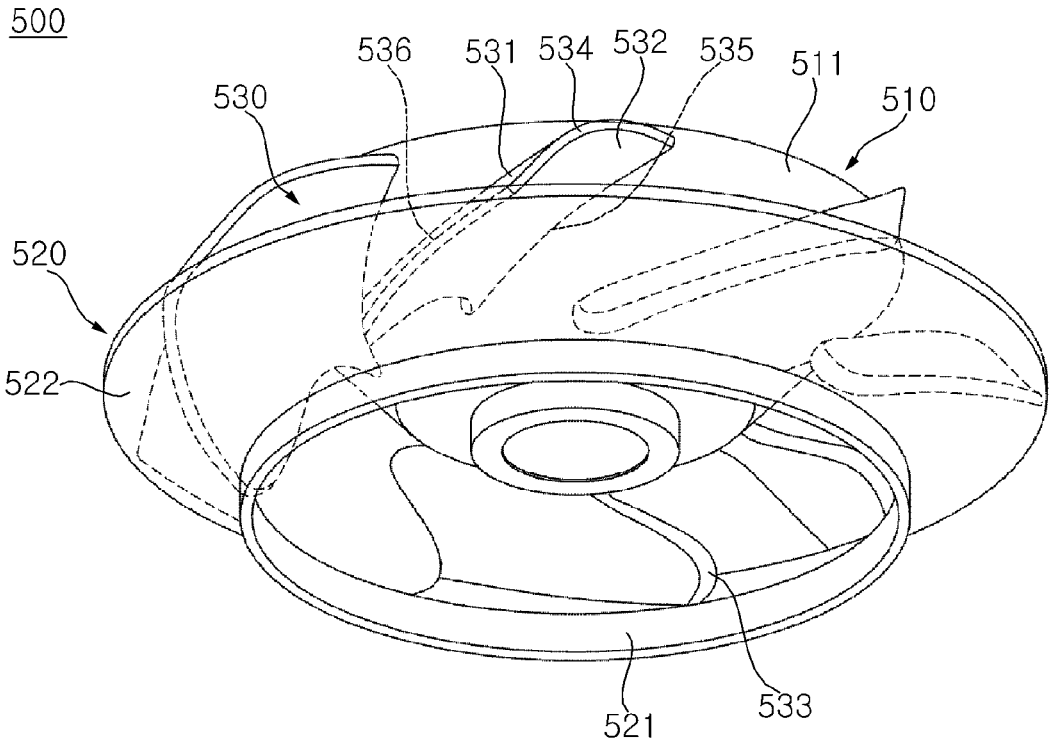
FIG. 8 is a perspective view of a fan according to an embodiment of the present disclosure.
Figure 9:
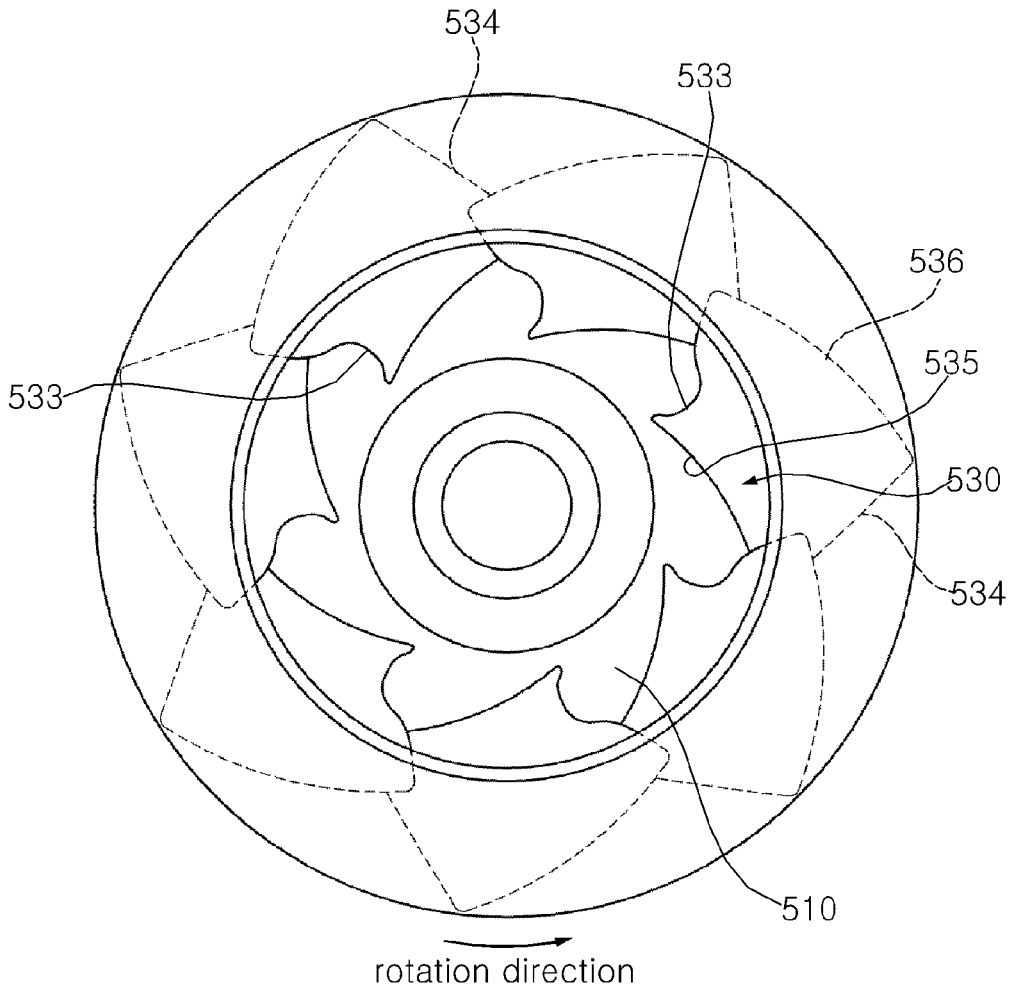
FIG. 9 is a bottom projection view of the fan according to an embodiment of the present disclosure.

Hereafter, the fan 500 according to an embodiment of the present disclosure is described with reference to FIGS. 8 and 9. FIG. 8 is a perspective view of the fan 500 according to an embodiment of the present disclosure and FIG. 9 is a view showing the fan 500 according to an embodiment of the present disclosure upward from under.

A mixed-flow fan may be used as the fan 500. However, the kind of the fan 500 is not limited to a mixed-flow fan and other kinds of fans may be used.

The fan 500 may include a hub 510 coupled to the fan 410, a shroud 520 disposed to be spaced under the hub 510, and a plurality of blades 530 connecting the shroud 520 and the hub 510.

A motor shaft 411 of the fan motor 410 is coupled to the center of the hub 510, and when the fan motor 410 is operated, the hub 510 may be rotated with the motor shaft 411.

When the fan 500 is rotated, air may flow toward the hub 510 from the shroud 520 of the fan 500.

The hub 510 may be formed in a bowl shape that is concave downward and the fan motor 410 may be disposed on the hub 510.

The hub 510 may include a first hub surface 511 disposed on the shroud 520 to face the shroud 520.

The first hub surface 511 may be a conical shape protruding downward, may have a transverse cross-section of which the shape is a circular shape, and may be a shape in which the diameter of a cross-section increases toward the upper end.

The shroud 520 may be disposed to be space under the hub 510 and may be disposed to surround the hub 510.

At least a portion of the hub 510 may be inserted in the center portion of the shroud 520. The diameter of the hub 510 may be smaller than the diameter of the shroud 520.

The shroud 520 may include a rim portion 521 extending in the circumferential direction and a supporting portion 522 extending to be inclined upward from the rim portion 521. The rim portion 521 and the supporting portion 522 may be integrally manufactured through injection molding.

The rim portion 510 may be formed in an annular shape. Air may be suctioned into the rim portion 510

The rim portion 521 may be formed such that the up-down height is longer than the thickness. The rim portion 521 may vertically extend up and down.

The extension length of the rim portion 511 in the up-down direction and the upward inclined extension length of the supporting portion 522 may have a ratio of 1:3.

The blades 530 may connect the hub 510 and the shroud 520 that are disposed to be spaced apart from each other. The upper ends of the blades 530 may be coupled to the hub 510 and the lower ends may be coupled to the shroud 520.

The blade 530 may include: a positive pressure surface 531 disposed toward the hub 510; a negative pressure surface 532 disposed toward the shroud 520; a root portion 535 connected with the hub 510; a tip portion 536 connected with the shroud 520; a leading edge 533 connecting one end of the root portion 535 and one end of the tip portion 536;

and a trailing edge 534 connecting another end of the root portion 535 and another end of the tip portion 536.

The root portion 535 and the tip portion 536 may be formed an airfoils.

The leading edge 533 may be a front end that first comes in contact with air when the hub 510 is rotated, and the trailing edge 534 may be a rear end that latest comes in contact with air when the hub 510 is rotated.

The leading edge 533 may be disposed toward the rotation center of the fan 500 and the trailing edge 534 may be disposed toward the outside in the radial direction of the fan 500.

The root portion 535 may be in contact with the first hub surface 511 of the hub 510 in an inclined type.

The top portion 536 may be in contact with the supporting portion 552 of the shroud 520 in an inclined type.

The inclined extension length of the first hub surface 511 may be smaller than the length of the root portion 535. The root portion 535 may be connected to be inclined with respect to the first hub surface 1110.

The inclined extension length of the supporting portion 522 may be smaller than the length of the tip portion 536. The tip portion 536 may be connected to be inclined with respect to the supporting portion 522.

A plurality of blades 530 may be disposed to be spaced in the circumferential direction. The leading edge 533 of each of the plurality of blades 530 may be disposed to at least partially face the trailing edge 534 of adjacent blades 530. Accordingly, when the fan 500 is seen from under, as in FIG. 9, the leading edge 533 of any one blade 530 may be seen like overlapping the trailing edge 534 of an adjacent blade 530.

Figure 10:
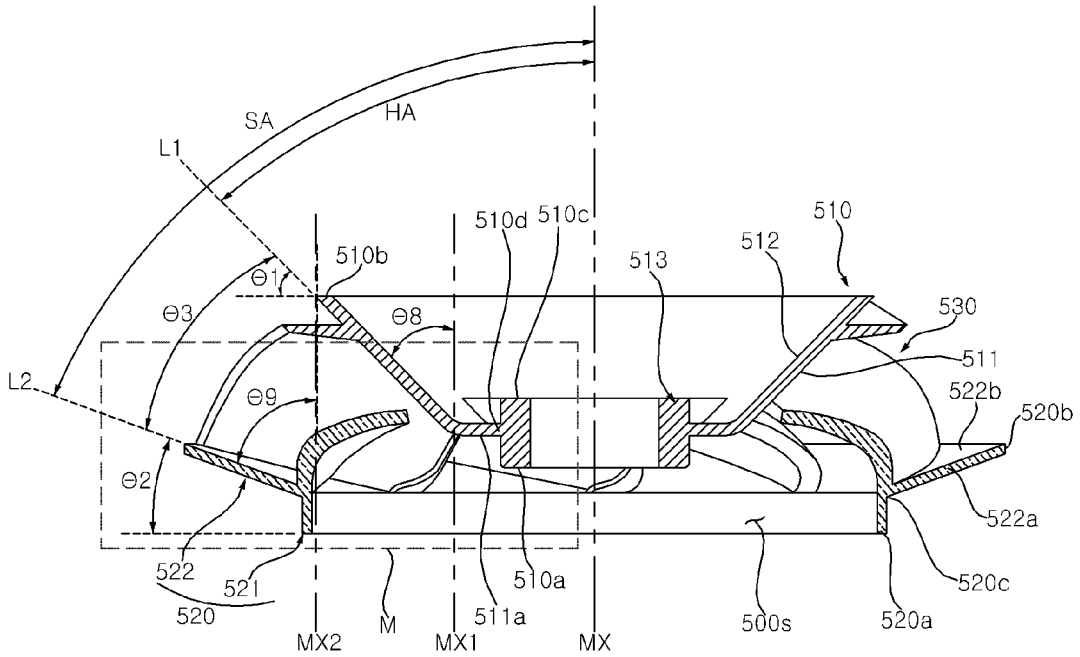
FIG. 10 is a vertical cross-sectional projection view of the fan according to an embodiment of the present disclosure.
Figure 11:
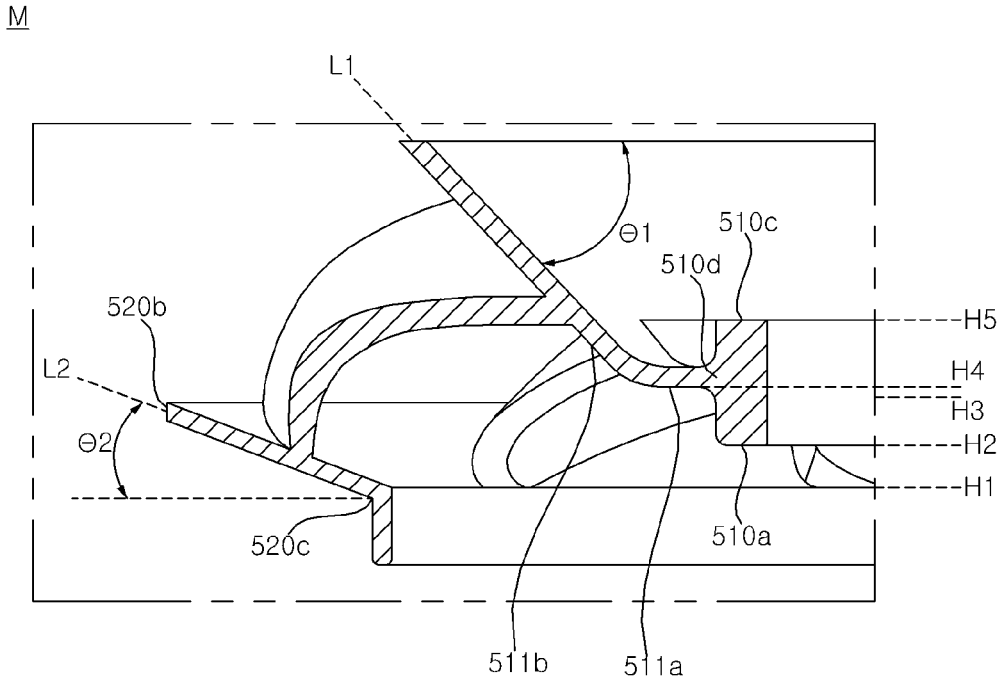
FIG. 11 is an enlarged view of the region M shown in FIG. 10.

Hereafter, the position relationship of the hub 510 and the shroud 520 is described with reference to FIGS. 10 and 11. FIG. 10 is a cross-sectional projection view cutting the fan 500 in the longitudinal direction and FIG. 11 is a view enlarging the region M shown in FIG. 10.

The hub 510 may include a second hub surface 512 disposed toward the fan motor 410 and a shaft coupling portion 513 to which the motor 411 is coupled.

The first hub surface 511 may be disposed toward the lower side and the second hub surface 512 may be disposed toward the upper side. The fan motor 410 may be inserted in the second hub surface 512 and connected with the hub 510.

The motor shaft 411 of the fan motor 410 may be coupled to the shaft coupling portion 513. The shaft coupling portion 513 may be disposed to pass through the hub 510 in the up-down direction. The rotation center of the fan 500 may be formed inside the shaft coupling portion 513. The shaft coupling portion 513 may be formed integrally with the first hub surface 511 and the second hub surface 512.

The shaft coupling portion 513 may be formed to protrude downward from the first hub surface 511 and may be formed to protrude upward from the second hub surface 512.

The shaft coupling portion 513 may form a hub lower end 510*a* by protruding downward. The shaft coupling portion 513 may form a hub protrusion end 510*c* by protruding upward. The shaft coupling portion 513 may form a hub middle portion by being connected with the first hub surface 511.

The first hub surface 511 and the second hub surface 512 may extend to be inclined outward in the radial direction and may form a hub upper end 510*b*.

The hub 510 may extend in a straight line shape to be inclined outward in the radial direction. The inclined extension direction of the hub 510 is defined as L1 and the inclined angle of the hub 510 is defined as a hub inclination angle θ1. The diameter of the hub 510 may increase toward the outside in the radial direction, and the internal space of the hub 510 may expand upward. The hub inclination angle θ1 may be formed in the range of 45 degrees to 60 degrees.

The rim portion 521 may extend in the up-down direction and may form a fan suction hole 500*s* therein. The rim portion 521 may include a rim portion lower end 520*a* constituting the lower portion of the fan suction hole 500*s* and a rim portion upper end 520*d* connected with the supporting portion 522.

The supporting portion 522 may extend to be inclined outward in the radial direction from the rim portion upper end 520*c* and may form a shroud edge 520*b* at the outermost side in the radial direction. The rim portion upper end 520*c* may be the boundary of the rim portion 521 and the supporting portion 522.

The shroud 522 may include a first shroud surface 522*a* disposed toward the lower side and a second shroud surface 522*b* disposed toward the upper side. The first shroud surface 522*a* may be formed to face the suction grill 140 and the second shroud surface 522*b* may be formed to face the first hub surface 511. The rim portion 521 may protrude downward from the first shroud surface 522*a*. The blades 530 may be coupled to the second shroud surface 522*b*.

The hub upper end 510*b* may be disposed inside further than the rim portion 521 in the radial direction. It is possible to sufficiently secure the length of the blades 530 and increase an air volume by sufficiently spacing the hub upper end 510*b* and the shroud edge 520*b*.

At least a portion of the diffuser 440 that will be described below may be disposed between the hub upper end 510*b* and the shroud edge 520*b*. The height at which at least a portion of the diffuser 440 is disposed may be formed between the hub upper end 510*b* and the shroud edge 520*b*.

The shroud 520 may extend in a straight line shape to be inclined outward in the radial direction. The inclined extension direction of the shroud 520 is defined as L2 and the inclined angle of the shroud 520 is defined as a shroud inclination angle θ2. The diameter of the shroud 520 may increase toward the outside in the radial direction, and the internal space of the shroud 520 may expand upward. The shroud inclination angle θ2 may be formed in the range of 35 degrees to 50 degrees.

The hub inclination angle θ1 and the shroud inclination angle θ2 may be formed to be different, and a flow passage through which air flowing inside through the fan suction hole 500*s* may be formed between the hub 510 and the shroud 520. The contained angle between the hub 510 and the shroud 520 is defined as an expansion angle θ3. A flow passage having the size of the expansion angle θ3 may be formed between the hub 510 and the shroud 520.

The hub inclination angle θ1 may be formed to be larger than the shroud inclination angle θ2. Since the hub inclination angle θ1 is formed to be larger than the shroud inclination angle θ2, it is possible to increase the size of the expansion angle θ3 and it is possible to reduce friction resistance acting in the air passing through the fan suction hole 500*s*.

The hub 510 may have an outer surface 511 extending to be inclined at a first angle θ8 with respect to the motor shaft 411. The outer surface 511 may be the first hub surface 511.

The shroud 520 may extend to be inclined at a second angle θ9 that is larger than the first angle θ8 with respect to the motor shaft 411.

The inner surface of the supporting portion 522 of the shroud 520 may face the outer surface 511 of the hub 510 with the blades 530 therebetween.

The motor shaft 411 may rotate the hub 510 and the blades 530 by being inserted in the shaft coupling portion 513 and may form a rotation axis MX of the fan 500.

The hub upper end 510*b* may form a hub area HA by being spaced apart from the rotation axis MX by a predetermined angle. The shroud edge 520*b* may form a shroud area SA by being spaced apart from the rotation axis MX by a predetermined angle.

The size of the shroud area SA may be larger than the size of the hub area HA.

The hub 510 may extend to be inclined at the first angle θ8 with respect to a first axis MX1 that is parallel with the rotation axis MX and passes through the shaft coupling portion 513.

The shroud 520 may extend to be inclined at the second angle θ9 with respect to a second axis MX2 that is parallel with the rotation axis MX and passes through the rim portion 521.

The size of the first angle θ8 may be smaller than the second angle θ9.

The sum of the hub inclination angle θ1 and the first angle θ8 may be 90 degrees, and the sum of the shroud angle θ2 and the second angle θ9 may be 90 degrees.

The height of the rim portion upper end 520*c* is defined as H1, the height of the hub lower end 510*a* is defined as H2, the height of the shroud edge 520*b* is defined as H3, the height of the hub middle portion 510*d* is defined as H4, and the height of the hub protrusion end 510*c* is defined as H5.

The fan 500 may be formed in a shape satisfying the relationship of H5>H4>H3>H2>H1. In detail, the hub lower end 510*a* may be formed higher than the rim portion upper end 520*c*, the shroud edge 520*b* may be formed higher than the hub lower end 510*a*, the hub middle portion 510*d* may be formed higher than the shroud edge 520*b*, and the hub protrusion end 510*c* may be formed higher than the hub middle portion 510*d*.

The height H3 of the shroud edge 520*b* may be formed between the height H2 of the hub lower end 510*a* and the height H5 of the hub protrusion end 510*c*. The height H3 of the shroud edge 520*b* may be formed between the height H2 of the hub lower end 510*a* and the height H4 of the hub middle portion 510*d*.

The first hub surface 511 may include a first guide surface 511*a* connected with the shaft coupling portion 513 and a second guide surface 511*b* extending to be inclined upward from the first guide surface 511*a*. The first guide surface 511*a* may horizontally extend from the shaft coupling portion 513 and the second guide surface 511*b* may extend upward from the outer end of the first guide surface 511*a*.

Due to the structure described above, air flowing inside through the fan suction hole 500*s* and reaching the first guide surface 511*a* may flow upward along the second guide surface 511*b* without going out to the upper side of the shroud edge 520*b*. Air flowing inside through the fan suction hole 500*s* may be guided to flow in the range of the expansion angle θ3 without going to the outside of the fan 500 through the shroud 520*b*, so a flow loss can be reduced.

Figure 12:
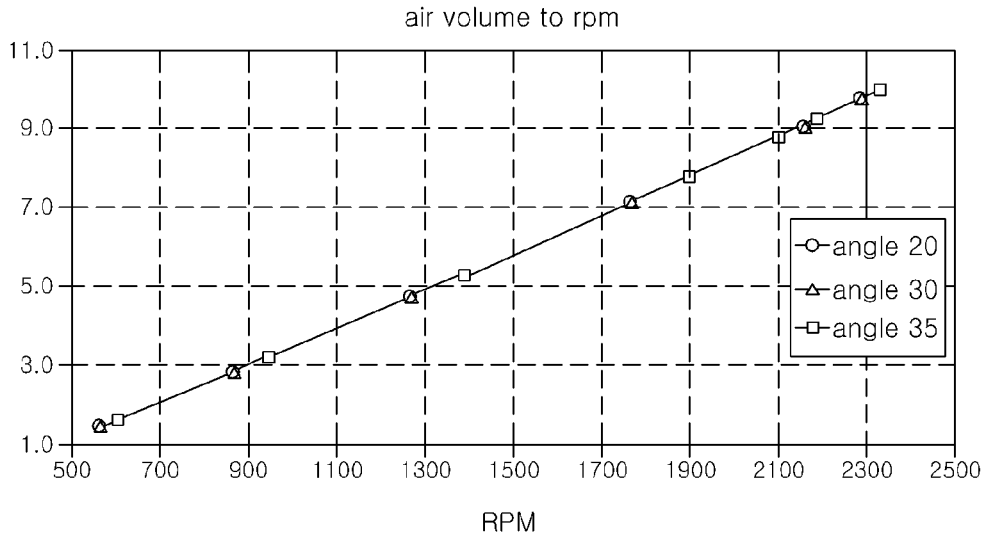
FIG. 12 is a graph showing air volume performance of the fan according to an embodiment of the present disclosure.
Figure 13:
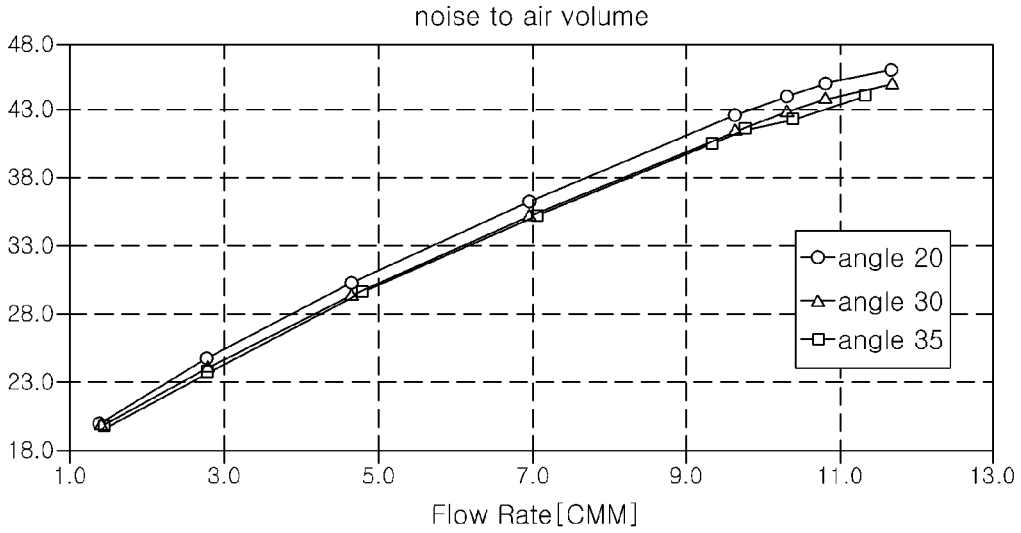
FIG. 13 is a graph showing noise performance of the fan according to an embodiment of the present disclosure.

Hereafter, an operation effect on air volume and noise according to the shroud inclination angle θ2 is described with reference to FIGS. 12 and 13. FIG. 12 shows an air volume according to the shroud inclination angle θ2 in a graph and FIG. 13 shows noise according to the shroud inclination angle θ2 in a graph.

TABLE 1

| Shroud angle (F2) | RPM (@10 CMM) | dB(@10 CMM) | sharpness(@10 CMM) |
|---|---|---|---|
| 20 | 2250 | 41.9 | 1.17 |
| 30 | 2245 | 42.3 | 1.07 |
| 35 | 2231 | 43.3 | 1.06 |

Table 1 shows experiment results of the number of revolutions, noise, and sharpness of the fan 500 when an air volume is 10CMM. Referring to FIG. 13, it can be seen that as the RPM increases, the air volume increases when the shroud inclination angle θ2 is 20 degrees, 30 degrees, and 35 degrees.

Figure 14:
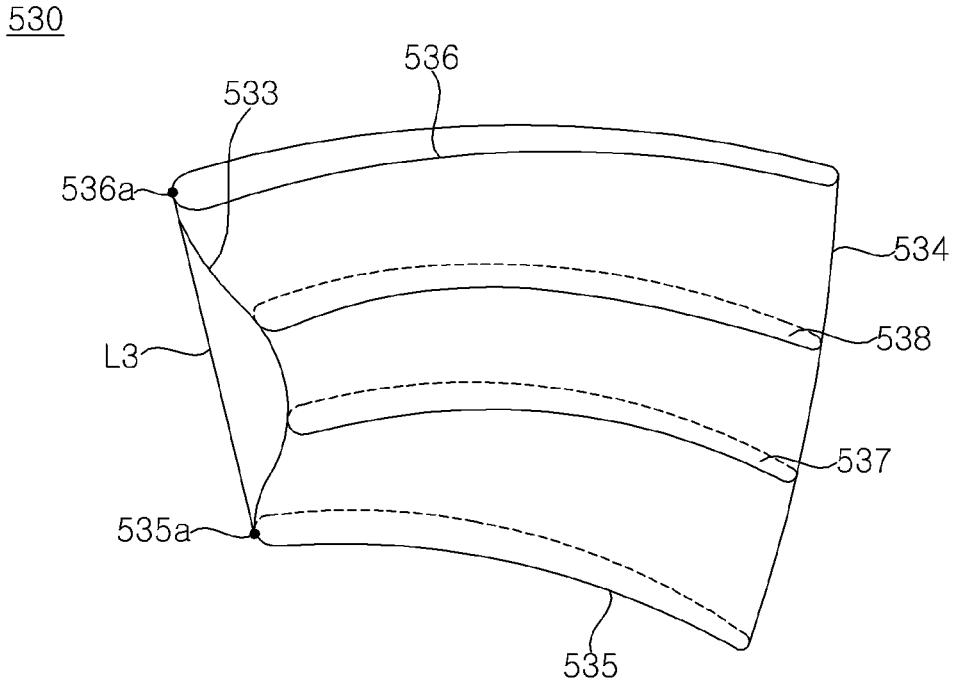
FIG. 14 is a design view of blades according to an embodiment of the present disclosure.

Referring to FIG. 14, it can be seen that as the air volume increases, the noise also increases when the shroud inclination angle θ2 is 20 degrees, 30 degrees, and 35 degrees. However, it can be seen that as the shroud inclination angle θ2 decreases, noise is large, and as the shroud inclination angle θ2 increases, noise decreases.

The expansion angle θ3 may be set in the range of 11 degrees and 26 degrees in consideration of noise and an air volume, and preferably, the expansion angle θ3 may be 12 degrees.

Figure 15:
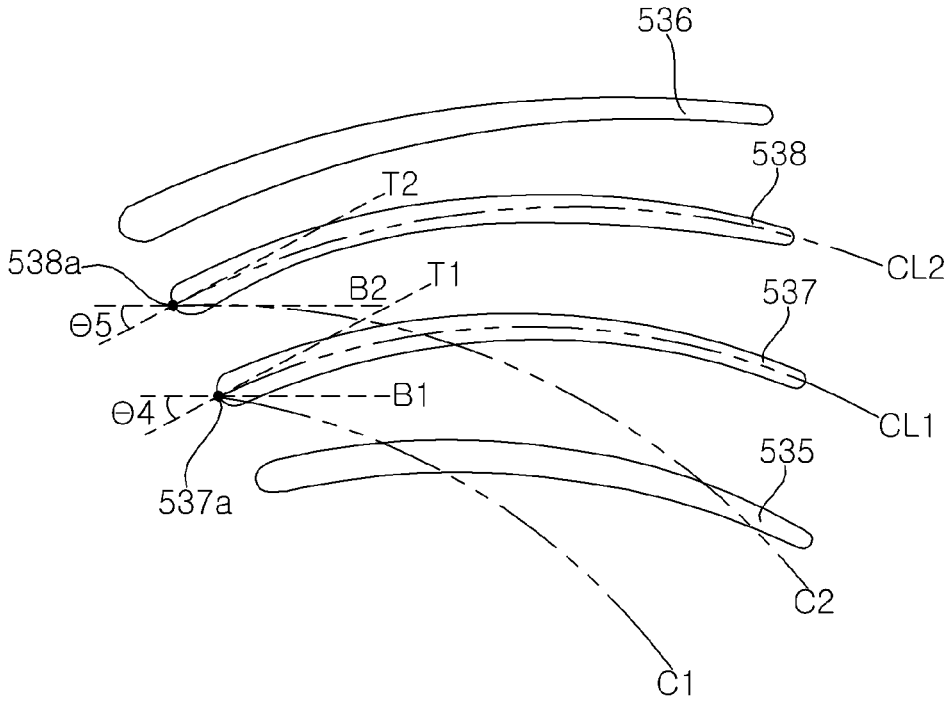
FIG. 15 is a structure view of airfoils of blades according to an embodiment of the present disclosure.

Hereafter, the blades 530 according to an embodiment of the present disclosure is described with reference to FIGS. 14 and 15. FIG. 14 shows one blade 530 and FIG. 15 shows a plurality of airfoils 535, 536, 537, and 538 constituting one blade 530.

A great number of airfoils may be formed from the root portion 535 to the tip portion 536 of the blade 530, and the blade 530 may be understood as a group of a plurality of airfoils. The airfoil may also be understood as a cross-sectional shape of the blade 530. The root portion 535 and the tip portion 536 may be included in a plurality of airfoils.

In the plurality of airfoils, any one airfoil between the root portion 535 and the tip portion 536 may be defined as reference airfoils 537 and 538.

The reference airfoils 537 and 538 may be defined as airfoils of which the distance from the root portion 535 and the tip portion 536 makes a constant reference ratio.

The distance from the reference airfoils 537 and 538 to the root portion 535 may be a first distance and the distance from the reference airfoils 537 and 538 to the tip portion 536 may be a second distance. The ratio of the first distance and the second distance may be 1:2, and the reference airfoil 537 in this case may be defined as a first reference airfoil 537. The ratio of the first distance and the second distance may be 2:1, and the reference airfoil 538 in this case may be defined as a second reference airfoil 538.

The leading edge 533 may be formed to be curved along the plurality of airfoils 535, 536, 537, and 538.

The root portion 535 may form a first intersection point 535*a* with the leading edge 533 and the tip portion 536 may form a second intersection point 536*a* with the leading edge 533. The leading edge 533 may extend to be curved from the first intersection point 535*a* to the second intersection point 536*a*.

A virtual leading line L3 connecting the first intersection point 535*a* to the second intersection point 536*a* may be formed. The leading edge 533 may be formed to be spaced apart from the leading line L3.

The first reference airfoil 537 may form a third intersection point 537*a* with the leading edge 533 and the second reference airfoil 538 may form a fourth intersection point 538*a* with the leading edge 533.

The third intersection point 537*a* may be understood as a point at which a first mean camber line CL1 of the first reference airfoil 537 crosses the leading edge 533.

The fourth intersection point 538*a* may be understood as a point at which a second mean camber line CL2 of the second reference airfoil 538 crosses the leading edge 533.

A third intersection point 537*a* and the fourth intersection point 538*a* may be formed to be spaced apart from the leading line L3.

The traces of the intersection points 535*a*, 536*a*, 537*a*, and 538*a* formed by rotation of the fan 500 may form a circle around the motor shaft 411. The traces of the intersection points 535*a*, 536*a*, 537*a*, and 538*a* may be understood as constituting a portion of the trace of the leading edge 533.

The third intersection point 537*a* may form a circular first trace C1 by rotation of the fan 500. The fourth intersection point 538*a* may form a circular second trace C2 by rotation of the fan 500.

The leading edge 533 of the blade 530 may be designed on the basis of inlet angles θ4 and θ5 of the reference airfoils 537 and 538.

The first inlet angle θ4 of the first reference airfoil 537 may mean an angle made by an extension line of the first mean camber line CL1 and the first trace C1.

The tangential line of the first mean camber line CL1 at the third intersection point 537*a* is defined as a first tangential line T1 and the tangential line of the first trace C1 at the third intersection point 537*a* is defined as a first base line B1.

The first inlet angle θ4 of the first reference airfoil 537 may be understood as the angle between the first tangential line T1 and the first base line B1.

The second inlet angle θ4 of the second reference airfoil 538 may mean an angle made by an extension line of the second mean camber line CL2 and the second trace C2.

The tangential line of the second mean camber line CL2 at the fourth intersection point 538*a* is defined as a second tangential line T2 and the tangential line of the second trace C2 at the fourth intersection point 538*a* is defined as a second base line B2.

The second inlet angle θ5 of the second reference airfoil 538 may be understood as the angle between the second tangential line T2 and the second base line B2.

The blade 530 may be formed such that the inlet angle can be varied in a span direction. The inlet angle may be continuously varied in the span direction. The span direction may mean an extension direction of the leading edge 533 formed to be curved toward the second intersection point 538*a* from the first intersection point 537*a*.

The inlet angle of the blade 530 in the span direction may be changed to implement an appropriate airfoil at different positions of the leading edge 533 in accordance with the characteristics of flow at the positions. AS the inlet angle of the blade 530 in the span direction is changed, the shape of the leading edge 533 may be formed to be curved.

A virtual blade extending such that the leading edge has the same inlet angle in the span direction may be defined as a "first comparative blade". The inlet angle of the first comparative blade is the same in all airfoils.

The inlet angles θ4 and θ5 of the reference airfoils 537 and 538 of the blade 530 according to an embodiment of the present disclosure may be larger of the inlet angle of the first comparative blade.

A blade in which the leading edge straightly extends from the rood portion to the tip portion may be defined as a "second comparative blade". In the second comparative blade, the leading line L3 defined in the description of the present disclosure may coincide with the leading edge 533.

The first comparative blade and the second comparative blade may have a comparative root portion and a comparative tip portion that are the same as the root portion 535 and the tip portion 536 of the present disclosure.

Comparing the inlet angles at the same position of the blade 530 of the present disclosure and the comparative blade, the inlet angle of the blade 530 of the present disclosure may be larger than the inlet angle of the comparative blade.

TABLE 2

| Items | Inlet angle of airfoil (°) | Noise Resultant value (dB@10 CMM) |
|---|---|---|
| Comparative blade | 24.5 | 47.2(—) |
| Blade of disclosure | $17.5 < \theta \leq 20.5$ | 47.5(↑0.3) |
| | $20.5 < \theta \leq 23.5$ | 47.3(↑0.1) |
| | $23.5 < \theta \leq 26.5$ | 47.2(—) |
| | $26.5 < \theta \leq 29.5$ | 47.0(↓0.2) |
| | $29.5 < \theta \leq 32.5$ | 46.7(↓0.5) |

Table 2 is a table showing a noise resultant value according to the inlet angle of an airfoil. The inlet angle of an airfoil that is a comparison target mean the inlet angle of an airfoil positioned at a ⅔ position of the root portion and the tip portion (the position of the second reference airfoil 538 of the present disclosure).

The inlet angle of the airfoil of the comparative blade may be 24.5°, and a noise resultant value may be measured by setting the inlet angle of the airfoil of the comparative blade as a comparison group and the inlet angle θ5 of the second reference airfoil 538 as an experiment group.

The noise resultant value is a value obtained by measuring decibel dB when an air volume is 10CMM.

According to Table 2, the inlet angle θ5 of the second reference airfoil 538 exceeds 29.5° and is 32.5° or less, the noise resultant value may be lowest as 46.7 dB.

The inlet angle θ5 of the second reference airfoil 538 may have a value that exceeds 29.5° and is 32.5° or less.

When the inlet angle θ5 of the second reference airfoil 538 has a larger value, noise has tendency of decreasing.

However, other factors such as the area, the thickness, the length, etc. of the blade complexly influence noise, so when the inlet angle θ5 of the second reference airfoil 538 exceeds 33°, noise has tendency of increasing again.

The first reference airfoil 537 may be an airfoil at a ⅓ position of the root portion 535 and the tip portion 536, and the second reference airfoil 538 may be an airfoil at a ⅔ position of the root portion 535 and the tip portion 536.

The blade 530 may be designed on the basis of the first inlet angle θ4 of the first reference airfoil 537 and the second inlet angle θ5 of the second reference airfoil 538.

In the blade 530, an optimal inlet angle may be primarily selected on the basis of the second inlet angle θ5 and then the first inlet angle θ4 may be selected through a 2-factor 2-level experiment.

It is possible to calculate the second inlet angle θ5 at which noise least generated by performing an experiment on the second inlet angle θ5 of the second reference airfoil 538 and it is possible to perform an optimal experiment while changing the first inlet angle θ4 with the second inlet angle θ5 obtained.

The optimal experiment may be performed on the decibel dB measured when the air volume is 3CMM.

In order to calculate optimal first inlet angle θ4 and second inlet angle θ5, an experiment may be performed on the basis of the case in which the comparative target inlet angle at a ⅓ position of the root portion and the tip portion of the comparative blade is around 21.5° and the comparative target inlet angle at a ⅔ position of the root portion and the tip portion is around 24.5°.

It is possible to calculate an optimal value while changing the second inlet angle θ5 on the basis of the case in which the comparative target inlet angle at a ⅔ position of the root portion and the tip portion is 24.5°. The optimal second inlet angle θ5 primarily selected may exceed 29.5° and may be 32.5° or less, depending on experiments.

Thereafter, in order to select first inlet angle θ4 and second inlet angle θ5, an experiment may be performed on the basis 21.5° that is the comparative target inlet angle at a ⅓ position of the root portion and the tip portion of the comparative blade and 32.5° that is one of the selected optimal second inlet angles θ5.

In detail, it is possible to measure a noise resultant value y while changing the sizes of the first inlet angle θ4 and the second inlet angle θ5 on the basis of points at which the first inlet angle θ4 and the second inlet angle θ5 are 21.5° and 32.5°.

TABLE 3

| Inlet angle of first reference airfoil (°) | Inlet angle of second reference airfoil (°) | Noise resultant value (dB@3.0 CMM) |
|---|---|---|
| 19 < θ1 ≤ 20.5 | 29 < θ2 ≤ 30.5 | 42.8 < y |
| 19 < θ1 ≤ 20.5 | 33.5 < θ2 ≤ 35 | 42.7 < y |
| 20.5 < θ1 ≤ 23.5 | 30.5 < θ2 ≤ 33.5 | 42.4 < y ≤ 42.6 |
| 23.5 < θ1 ≤ 25 | 29 < θ2 ≤ 30.5 | y ≤ 42.4 |
| 23.5 < θ1 ≤ 25 | 33.5 < θ2 ≤ 35 | 42.4 < y ≤ 42.6 |

Table 3 shows the results of experiments performed on a first inlet angle θ4 and a second inlet angle θ5 in the way described above.

According to the experiment results, when the first inlet angle θ4 is smaller than a set reference, the noise shows only tendency of increasing. However, when the first inlet angle θ4 is larger than the set reference, the noise is influenced by the second inlet angle θ5.

According to the experiment results, the optimal first inlet angle θ4 may exceed 23.5° and may be 25° or less and the second inlet angle θ5 may exceed 29° and may be 30.5° or less.

When the first inlet angle θ4 exceeds 23.5° and is 25° or less and the second inlet angle θ5 exceeds 29° and is 30.5° or less, the noise resultant value y is 42.4 dB.

Figure 16:
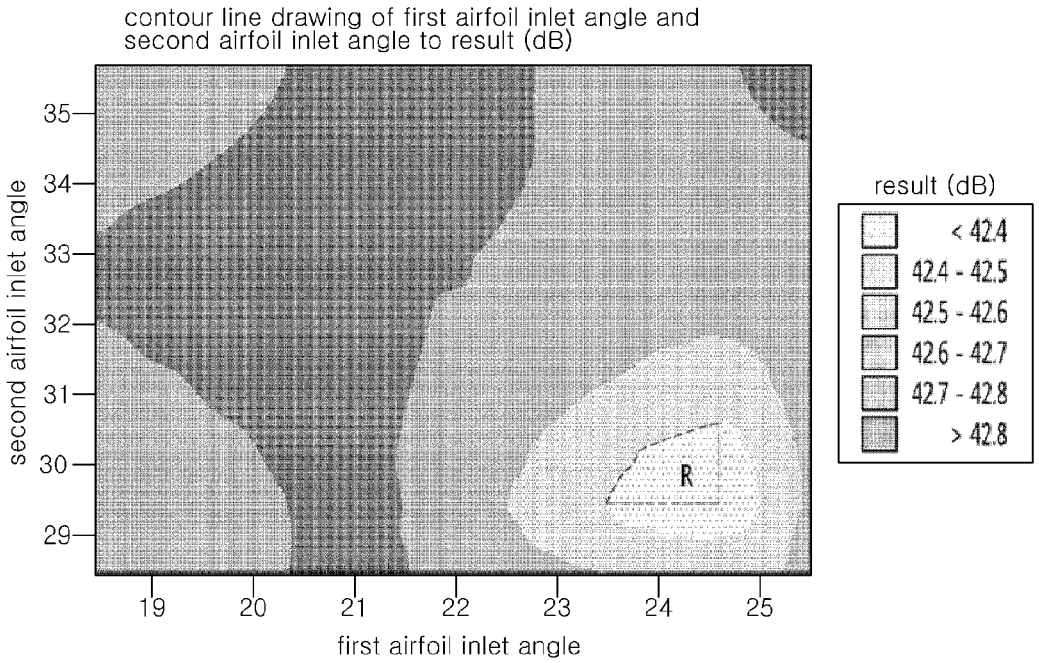
FIG. 16 is a contour diagram showing optimal design of blades according to an embodiment of the present disclosure.

Referring to FIG. 16, noise resultant values measured by repeating experiments in the way described above can be seen through a contour line.

According to FIG. 16, the first inlet angle θ4 and the second inlet angle θ5 corresponding to a region in which noise decreases to 42.4 dB or less may be appropriate values for noise reduction.

The region in which noise decreases to 42.4 dB or less may be a section smoothly connecting three points at which the first inlet angle θ4 and the second inlet angle θ5 are (23.5°, 29.2°), (24.5°, 30.5°), and (25°, 29.5°).

An optimal region R having the lowest noise value in the region in which noise decreases to 42.4 dB or less may be composed of a log function connecting two points at which the first inlet angle θ4 and the second inlet angle θ5 are 23.5°, 0) and (24.5°30.5°), a straight line connecting two points of (23.5°, 0) and (24.5°, 0), and a straight line connecting two points of (24.5°, 0) and (24.5°, 30.5°).

Hereafter, a fan 600 according to another embodiment of the present disclosure is described with reference to FIG. 17.

Figure 17:
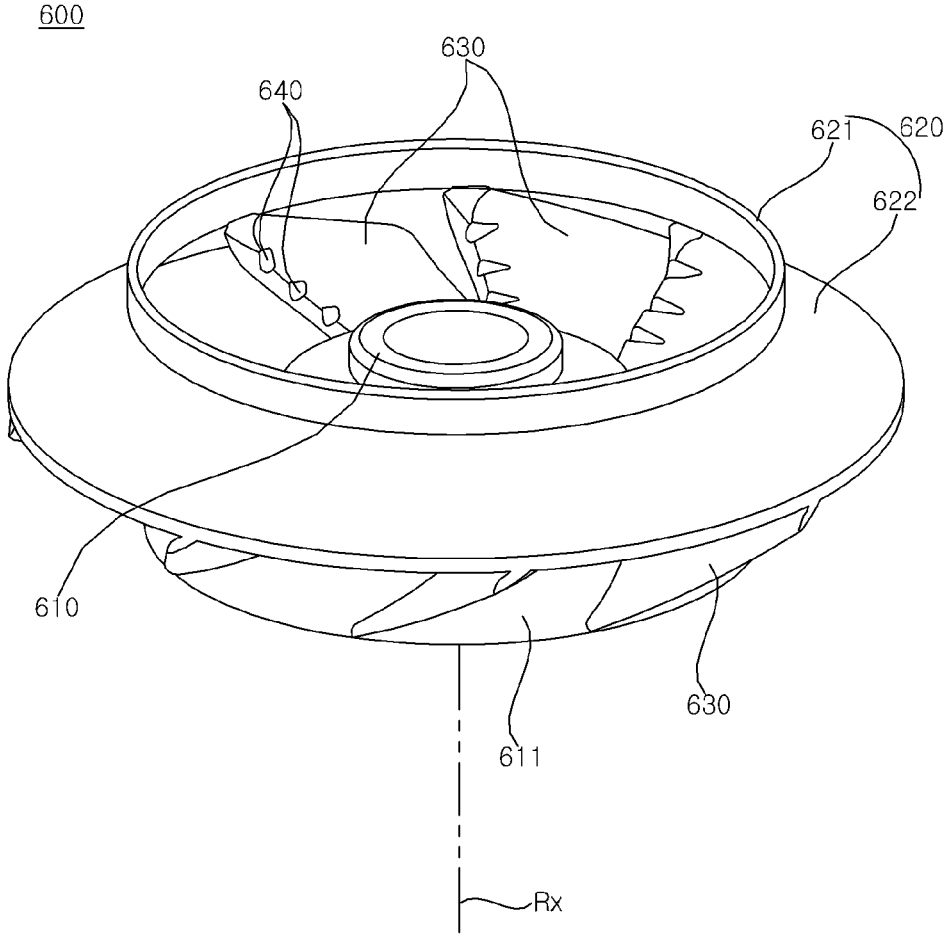
FIG. 17 is a perspective view of a fan according to another embodiment of the present disclosure.

FIG. 17 is a perspective view of a fan 600 according to another embodiment of the present disclosure.

The fan 600 may include: a hub 610 connected with a motor shaft 411; a shroud 620 disposed to be spaced apart from the hub 610; a plurality of blades 630 connecting the hub 610 and the shroud 620; and notches 640 formed at the plurality of blades 630.

The fan 600 is rotated in the circumferential direction about a rotation axis RX.

The shroud 620 may include a rim portion 621 extending in the circumferential direction and a supporting portion 622 extending to be inclined from the rim portion 621.

The hub 610 may include a first hub surface 611 that guides a flow direction of air suctioned in the fan 600.

In the fan 600 according to another embodiment of the present disclosure, the hub 610 and the shroud 620 are the same as the hub 510 and the shroud 520 according to an embodiment of the present disclosure, so detailed description is omitted.

Figure 18:
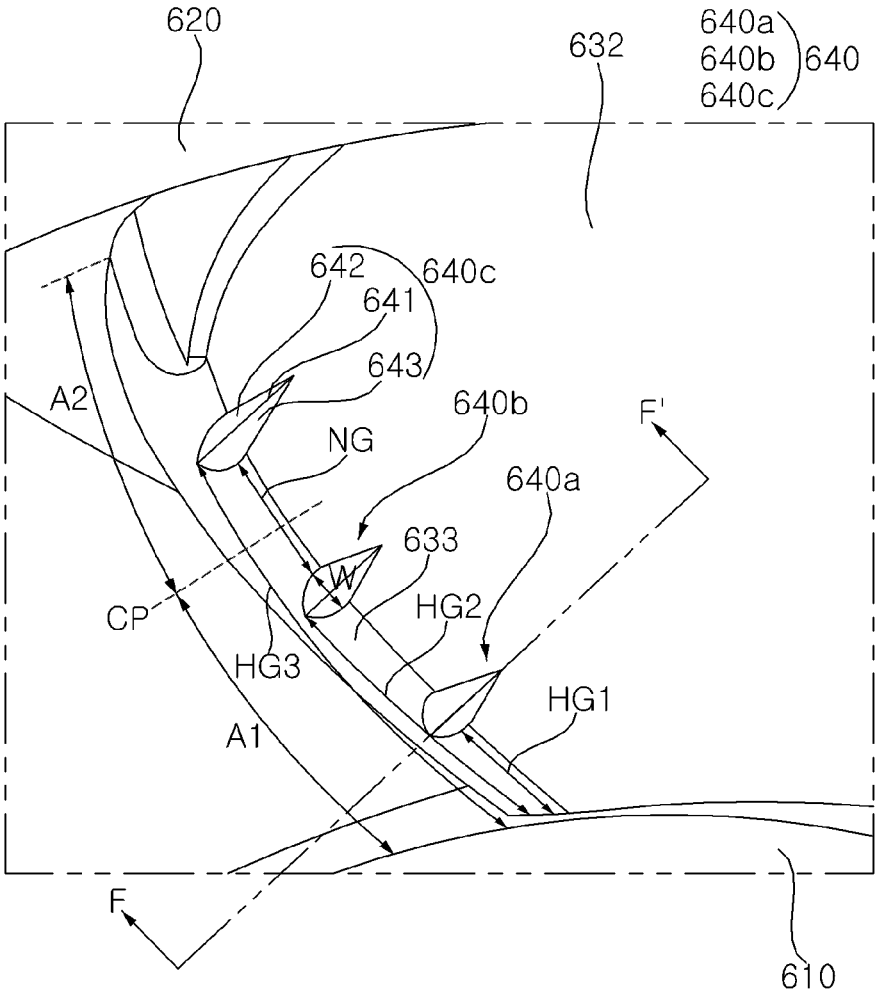
FIG. 18 is an enlarged view of blades according to another embodiment of the present disclosure.
Figure 19:
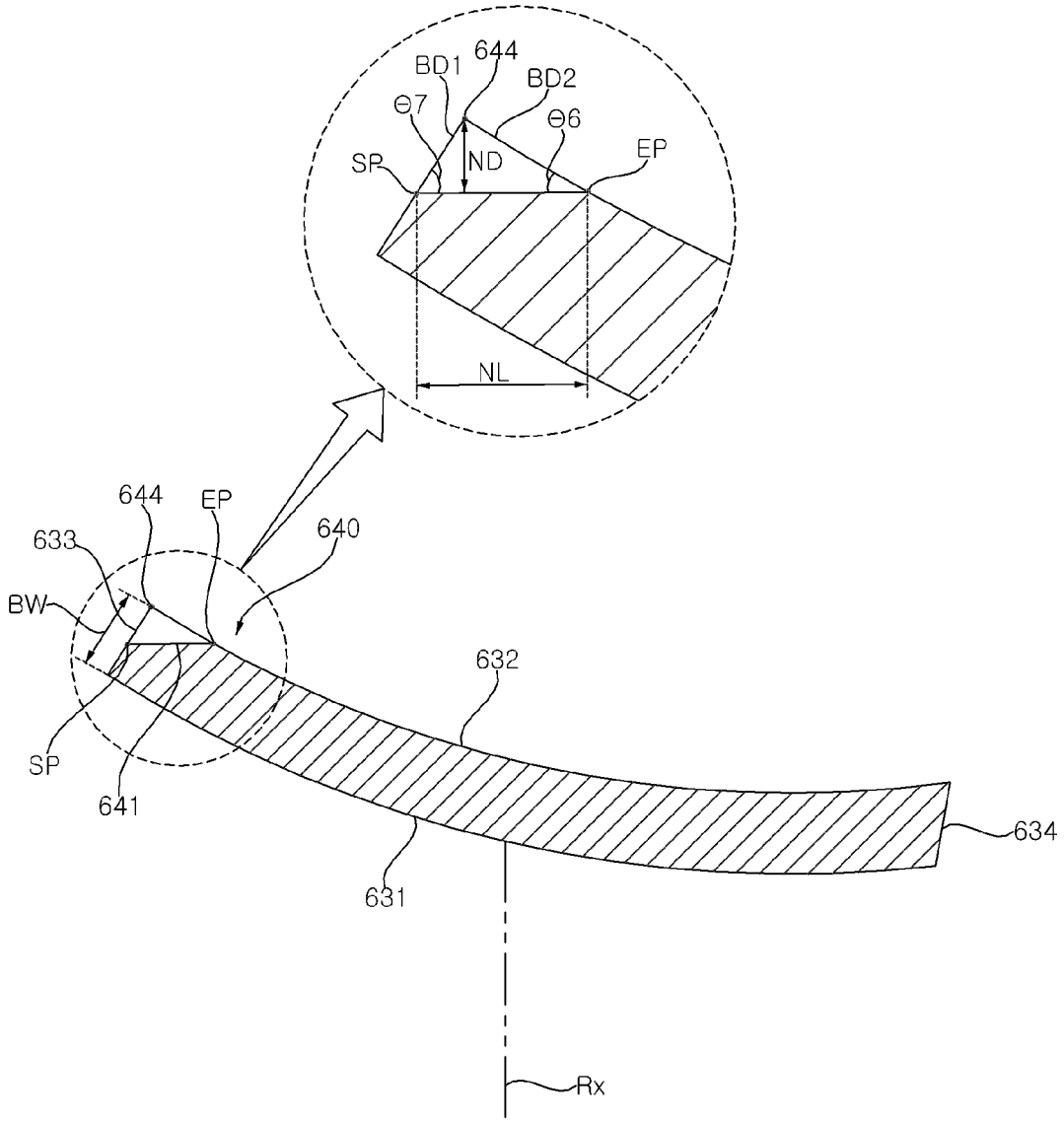
FIG. 19 is a vertical cross-sectional projection view of the blades according to another embodiment of the present disclosure.
Figure 20:
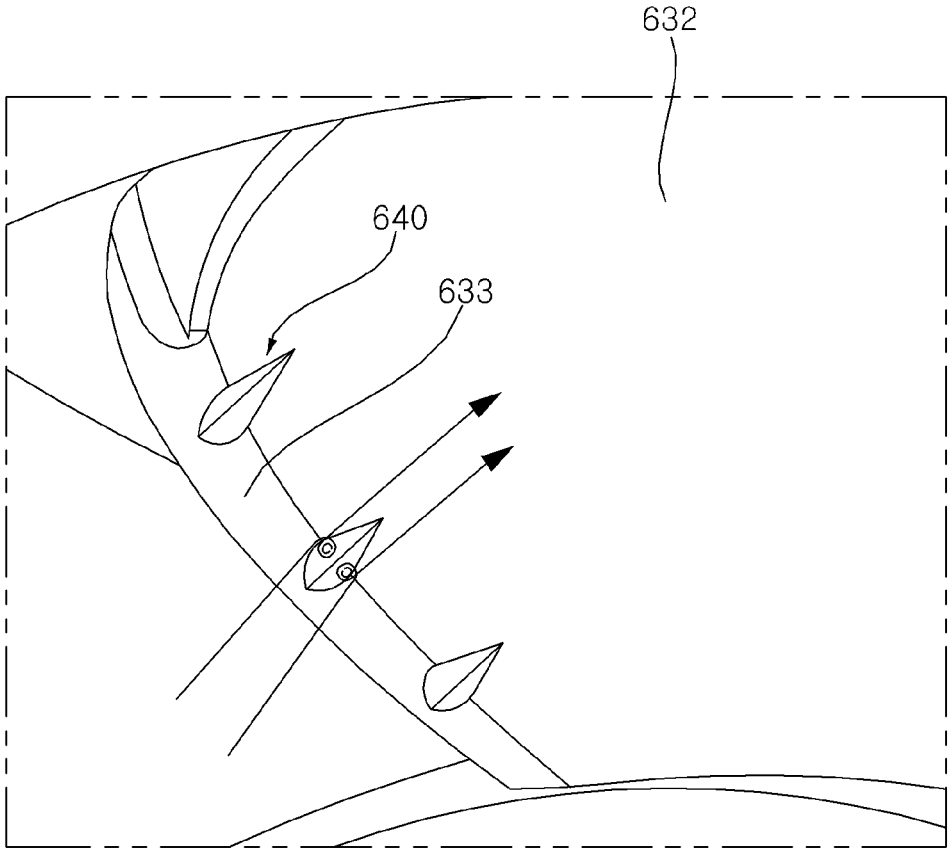
FIG. 20 is a view showing flow on a blade according to another embodiment of the present disclosure.

Hereafter, the notch 640 is described with reference to FIGS. 18 to 20. FIG. 18 is a view enlarging the blade 630, FIG. 19 is a view of the blade 630 cut along line F-F' shown in FIG. 18, and FIG. 20 is a view showing flow of air by the notch 640. Hereafter, the up-down direction is based on the direction shown in FIGS. 17 to 20 in the description of the notch 640.

The blade 630 may include: a leading edge 633 forming one side of the blade 630; a trailing edge 634 facing the leading edge 633; a negative pressure surface 632 connecting the upper end of the leading edge 633 and the upper end of the trailing edge 634; and a pressure surface 631 connecting the lower end of the leading edge 633 and the lower end of the trailing edge 634 and facing the negative pressure surface 632.

In the fan 600 according to another embodiment of the present disclosure, the description of the pressure surface 531, the negative pressure surface 532, the leading edge 533, and the trailing edge 534 according to an embodiment of the present disclosure may be applied in the same way to the description of the pressure surface 631, the negative pressure surface 632, the leading edge 633, and the trailing edge 634 except the description of the notch 640.

A plurality of notches 640 may be formed at each of a plurality of blades 630 to reduce noise generated at the fan and sharpness of the noise The notch 640 may be formed at a portion of the leading edge 633 and a portion of the negative pressure surface 632. The notch 640 may be formed by recessing downward a corner 644 at which the leading edge 633 and the negative pressure surface 632 meet. The notch 640 may be formed at the middle-upper end portion of the leading edge 633 and a partial region adjacent to the leading edge 633 of the negative pressure surface 632.

The notch 640 may be formed to be recessed toward the pressure surface 631 from the negative pressure surface 632.

The cross-sectional shape of the notch 640 is not limited and may have various shapes. However, it is preferable that the cross-sectional shape of the notch 640 has a U-shape or a V-shape to reduce efficiency and noise of the fan 600. The shape of the notch 640 will be described below.

The width W of the notch 640 may expand upward from the lower portion. The width W of the notch 640 may expand upward gradually or step by step.

The width W of the notch 640 may narrow toward the pressure surface 631. The width W of the notch 640 may expand toward the negative pressure surface 632.

In the notch 640, the same cross-sectional shape may extend in the radial direction.

The notch 640 may have a curved line shape and the same cross-sectional shape may extend in the circumferential direction in the notch 640.

The cross-sectional shape of the notch 640 may be a V-shape.

The notch 640 may include: a first inclined surface 642; a second inclined surface 643 facing the first inclined surface 642; and a bottom line 641 to which the first inclined surface 642 and the second inclined surface 643 are connected.

The spacing distance between the first inclined surface 642 and the second inclined surface 643 may increase toward one direction. The spacing distance between the first inclined surface 642 and the second inclined surface 643 may increase gradually or step by step. The first inclined surface 642 and the second inclined surface 643 may be flat surfaces or curved surfaces. The first inclined surface 642 and the second inclined surface 643 may be triangular shapes.

Three notches 640 may be formed. The notches 640 may include a first notch 640*a*, a second notch 640*b* positioned farther from the hub 610 than the first notch 640*a*, and a third notch 640*c* positioned farther from the hub 610 than the second notch 640*b*. The gaps NG between the notches 640 may be 6 mm to 10 mm. The gaps NG between the notches 640 may be larger that the depth ND of the notches 640 and the width W of the notches 640.

The leading edge 633 may be divided into a first area A1 adjacent to the hub 610 from an edge center line CP passing through the center of the leading edge 633 and a second area A2 adjacent to the shroud 620, and two of the three notches 640 may be positioned in the first area A1 and the other notch 640 may be positioned in the second area A2.

The first notch 640*a* and the second notch 640*b* may be positioned in the first area A1 and the third notch 640 may be positioned in the second area A2. A first distance HG1 of the first notch 640*a* spaced apart from the hub 610 may be 19% to 23% of the length of the leading edge 633, a second distance HG2 of the second notch 640*b* spaced apart from the hub 610 may be 40% to 44% of the length of the leading edge 633, and a third distance HG3 of the third notch 640*c* spaced apart from the hub 610 may be 65% to 69% of the length of the leading edge 633.

The length NL of each of the plurality of notches 640*a*, 640*b*, and 640*c* may be formed to be different. As the plurality of notches 640*a*, 640*b*, and 640*c* are far from the hub 610, the length NL may be increased. The length of the third notch 640*c* may be longer than the length of the second notch 640*b*, and the length of the second notch 640*b* may be longer than the length of the first notch 640*a*.

It is possible to reduce flow separation that is generated at the blade 630 of the fan 600 through the shape, the disposition, and the number of the notches 640 described above, and as a result, it is possible to reduce noise that is generated at the fan 600.

The bottom line 641 may extend in the direction of a tangential line of a certain circumference formed around a rotation axis RX. The bottom line 641 may extend along a certain circumference formed around the rotation axis RX. The bottom line 641 may form an arch shape around the rotation axis RX. The bottom line 641 may extend in an arch shape on a horizontal surface perpendicular to the rotation axis RX.

The bottom line 641 may extend by a length the same as the length NL of the notch 640. The extension direction of the bottom line 641 may be the extension direction of the notch 640. The extension direction of the bottom line 641 may be a direction for reducing flow separation that is generated at the leading edge 633 and the negative pressure surface 632 and for reducing resistance of air.

The bottom line 641 may have a slope of 0 degree to 10 degrees with respect to the horizontal surface perpendicular to the rotation axis RX. Preferably, the bottom line 641 may be formed in parallel with the horizontal surface perpendicular to the rotation axis RX. Accordingly, it is possible to reduce flow resistance according to rotation of the blade 630 by the notch 640.

The depth ND of the notch 640 may decrease as the depth ND goes far away from the corner 644. The depth ND of the notch 640 may be the highest at the corner 644 and may decrease as the depth ND goes far away from the corner 644.

The length NL of the bottom line 641 may be longer than the height BW of the leading edge 633. This is because when the length NL of the bottom line 641 is too short, flow separation that is generated at the negative pressure surface 632 cannot be reduced, and when the length NL of the bottom line 641 is too long, the efficiency of the fan is deteriorated.

The length NL of the notch 640 (the length NL of the bottom line 641) may be larger that the depth ND of the notches 640 and the width W of the notches 640. Preferably, the length NL of the notch 640 may be 5 mm to 6.5 mm, the depth ND of the notch 640 may be 1.5 mm to 2.0 mm, and the width W of the notch 640 may be 2.0 mm to 2.2 mm.

The length NL of the notch 640 may be 2.5 times to 4.33 times the depth of the notch ND and the length NL of the notch 640 may be 2.272 times to 3.25 times the width W of the notch 640.

A start point SP of thee bottom line 641 may be positioned at the leading edge 633 and an end point EP of the bottom line 641 may be positioned at the negative pressure surface 632. The position of the start point SP of the bottom line 641 at the leading edge 633 may be the medium height of the leading edge 633.

A first spacing distance BD1 between the start point SP and the corner 644 may be smaller than a second spacing distance BD2 between the end point EP and the corner 644.

It is preferable that the position of the end point EP may be formed between a ⅕ position to 1/10 position of the entire length of the negative pressure surface 632.

A first notch angle θ6 made by the bottom line 641 and the negative pressure surface 632 may be smaller than a second notch angle θ7 made by the bottom line 641 and the leading edge 633.

Referring to FIG. 20, a portion of the air passing through the leading edge 633 may guide the other air to flow over the negative pressure surface 632 of the blade 630 by generating a turbulent flow at the notch 640. Further, the air passing through the leading edge 633 does not generate friction by directly coming in contact with the surface of the blade 630 due to the turbulent flow formed at the notch 640, so it is possible to suppress flow separation and reduce noise that is generated at the blade 630.

Figure 21:
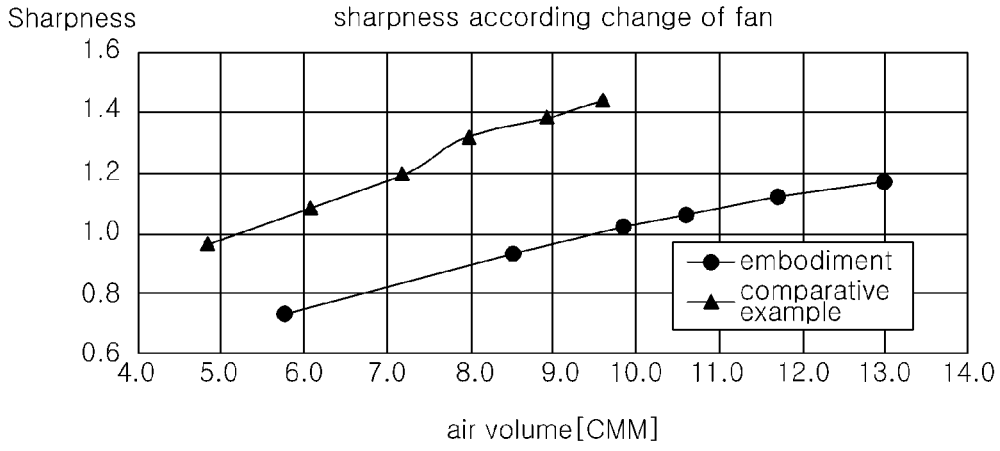
FIG. 21 is a graph showing air volume performance of the fan according to another embodiment of the present disclosure.

Hereafter, an operation effect on sharpness and noise of the fan 600 according to another embodiment of the present disclosure is described with reference to FIGS. 21 and 22. FIG. 21 is a graph showing a reduction effect of sharpness by the notch 640 and FIG. 22 is a graph showing a reduction effect of noise by the notch 640.

Referring to FIG. 21, it can be seen that the sharpness of the fan 600 having the notches 640 according to an embodiment of the present disclosure is formed less than the sharpness of a fan not having notches 640 according to a comparative example. It can be seen that when the air volumes are the same, flow separation at the leading edge 633 is suppressed because the fan 600 having the notches 640 according to an embodiment of the present disclosure has small sharpness in comparison to the comparative example.

Figure 22:
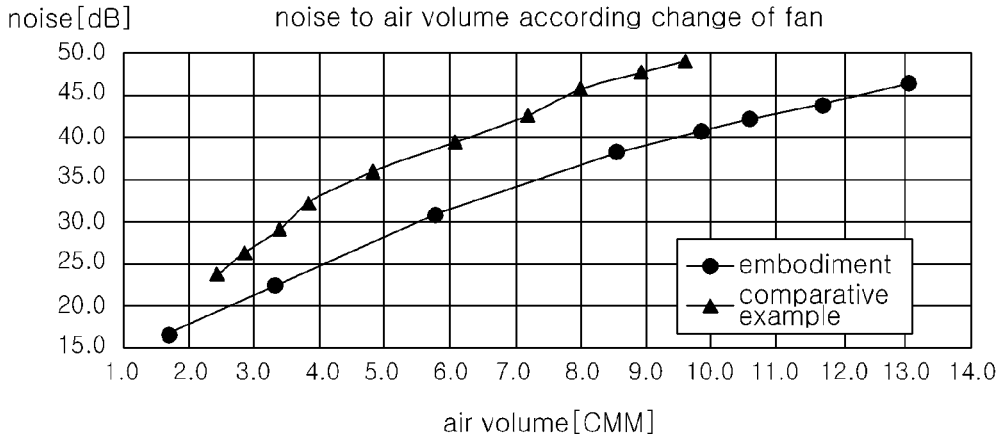
FIG. 22 is a graph showing noise performance of the fan according to an embodiment of the present disclosure.

Referring to FIG. 22, it can be seen that noise of the fan 600 having the notches 640 according to an embodiment of the present disclosure is formed less than noise of a fan not having notches 640 according to a comparative example. It can be seen that when the air volumes are the same, it is possible to increase blowing performance and reduce noise because the fan 600 having the notches 640 according to an embodiment of the present disclosure has small noise in comparison to the comparative example.

Figure 23:
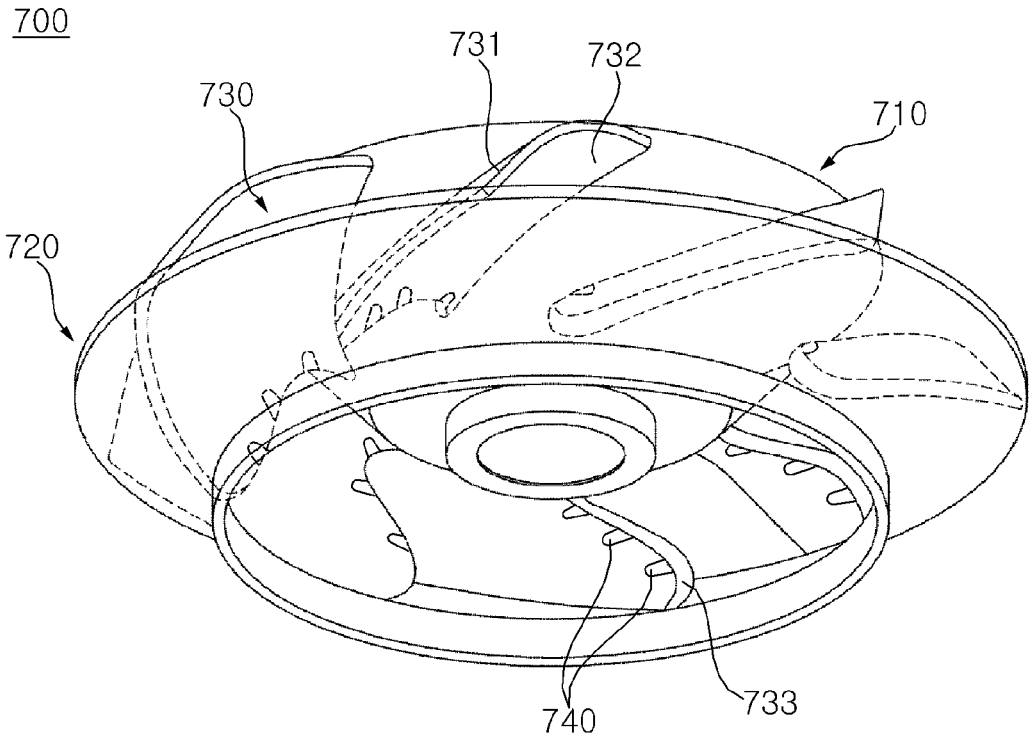
FIG. 23 is a perspective view of a fan according to another embodiment of the present disclosure.

Hereafter, a fan 700 according to another embodiment of the present disclosure is described with reference to FIG. 23. FIG. 23 shows the shape of the fan 700 having notches 740.

The fan 700 according to another embodiment of the present disclosure may include: a hub 710; a shroud 720; and blades 730 at each of which a positive pressure surface 731, a negative pressure surface 732, and a leading edge 733 are formed. The hub 710 and the shroud 720 are the same as the hub 510 and the shroud 520 of the fan according to an embodiment of the present disclosure, so detailed description is omitted.

A plurality of notches 740 formed to be recessed along the negative pressure surface 732 from the leading edge 733 may be formed at the blade 730.

The entire shape and the design structure of the blade are the same as the blade 530 of the fan 500 according to an embodiment of the present disclosure, and the shape and the design structure of the notch 740 are the same as the notch 640 of the fan 600 according to another embodiment of the present disclosure, so detailed description is omitted.

Figure 24:
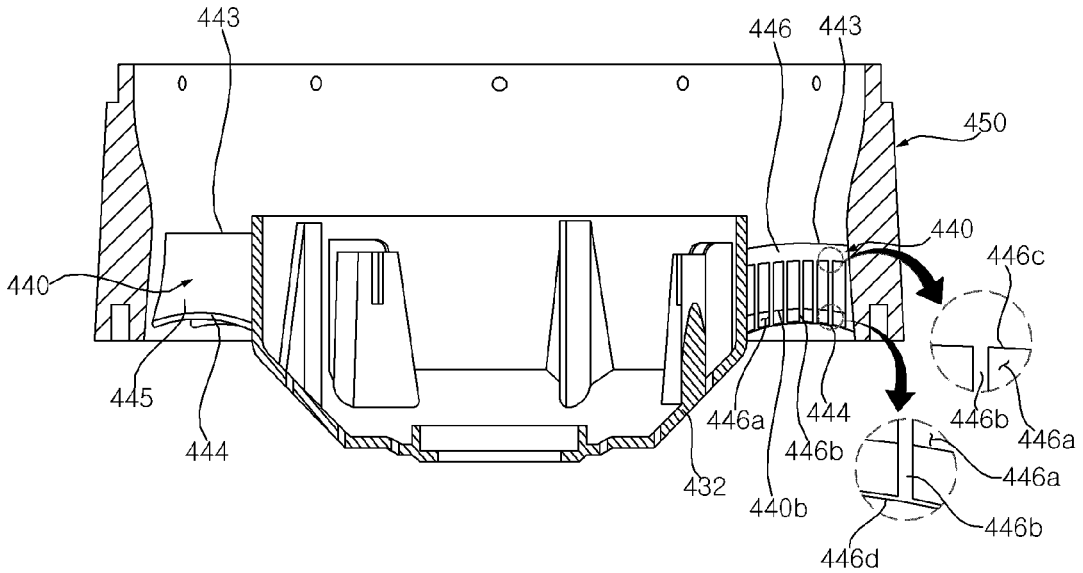
FIG. 24 is a vertical cross-sectional projection view of a fan assembly according to embodiments of the present disclosure.
Figure 25:
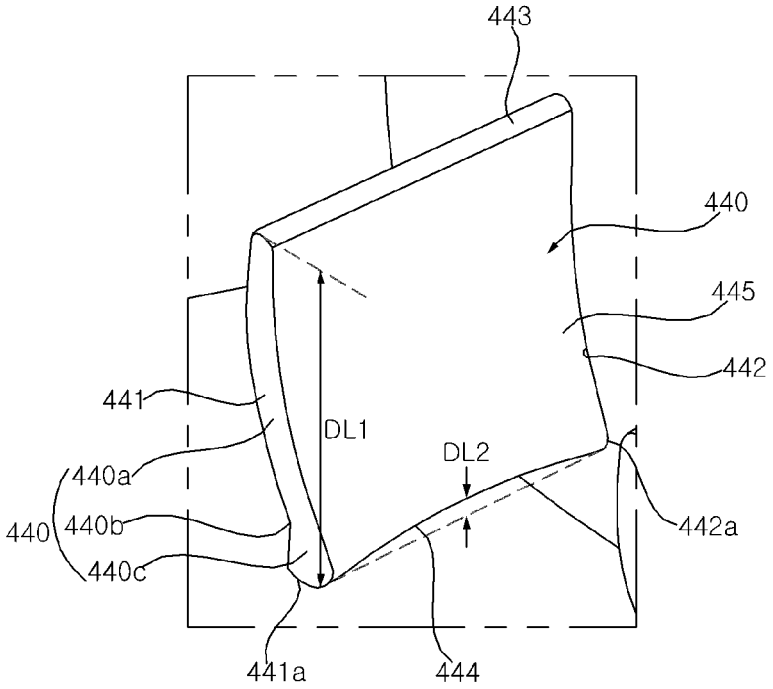
FIG. 25 is an enlarged view of a diffuser according to embodiments of the present disclosure.

Hereafter, the diffuser 440 of the fan assembly 400 is described with reference to FIGS. 24 and 25. FIG. 24 a projection view showing a portion of the fan assembly 400 longitudinally cut and FIG. 25 is a view enlarging the diffuser 440.

The fan assembly 400 may include a fan housing 450 that is open on the upper side and the lower side and in which the motor housing 430 is disposed to be spaced.

The diffuser 440 may be disposed between the fan housing 450 and the motor housing 430. The diffuser 440 may connect the fan housing 450 and the motor housing 430. A plurality of diffusers 440 may be disposed to be spaced apart from each other in the circumferential direction.

At least a portion of the diffuser 440 may be disposed between the hub upper end 510*b* and the shroud edge 520*b* in the radial direction. An inner edge 442 that will be described below may be positioned outside further than the hub upper end 510*b* in the radial direction and may be positioned inside further than the shroud edge 520*b* in the radial direction.

The diffuser 440 may extend to be inclined in the up-down direction and may be formed in an airfoil shape.

The diffuser 440 may guide air radially discharged from the fans 500, 600, and 700 to flow upward.

The diffuser 440 may include an outer edge 441 connected to the fan housing 450, an inner edge 442 connected to the motor housing 430, an upper edge 443 connecting upper portions of the outer edge 441 and the inner edge 442, a lower edge 444 connecting lower portions of the outer edge 441 and the inner edge 442, a first diffuser surface 445 extending up and down between the upper edge 443 and the lower edge 444, and a second diffuser surface 446 extending up and down between the upper edge 443 and the lower edge 444 and facing the first diffuser surface 445.

The first diffuser surface 445 and the second diffuser surface 446 each may be formed as a curved surface.

The first diffuser surface 445 may be formed to be connected with the outer edge 441, the inner edge 442, the upper edge 443, and the lower edge 444 and to face a side. The second diffuser surface 446 may be formed to be connected with the outer edge 441, the inner edge 442, the upper edge 443, and the lower edge 444 and to face a direction opposite to the first diffuser surface 445.

The first diffuser surface 445 of a plurality of diffusers 440 may face the second diffuser surface 446 of an adjacent diffuser 440. The second diffuser surface 446 of a plurality of diffusers 440 may face the first diffuser surface 445 of an adjacent diffuser 440.

The first diffuser surface 445 may be formed as a continuous curved surface and a plurality of diffuser grooves 446*a* may be formed at the second diffuser surface 446. The diffuser grooves 446*a* may extend in the up-down direction and may be formed to be recessed toward the first diffuser surface 445 from the second diffuser surface 446. The plurality of diffuser grooves 446*a* may be formed to be spaced apart from each other in the horizontal direction.

A rib 446 protruding from the second diffuser surface 446 may be formed between the plurality of diffuser grooves 446*a*. The diffuser grooves 446*a* may be formed by being recessed between a plurality of ribs 446.

The diffuser groove 446*a* may extend from a medium height of the second diffuser surface 446 to the lower edge 444.

The diffuser groove 446*a* may be formed to be concave toward the first diffuser surface 445 from the second diffuser surface 446.

A groove upper end 446*c* of the diffuser groove 446*a* may be positioned lower than the upper edge 443 and a groove lower end 446*d* may be positioned to be in contact with the lower edge 444. The groove upper ends 446*c* of the plurality of diffuser grooves 446*a* may be positioned on the same horizontal surface. A plurality of groove lower ends 446*d* may be formed in an arc shape along the lower edge 444.

The diffuser groove 446*a* may be formed to be bent at least one time in the up-down direction. A bending portion 440*b* that will be described below may be formed at the second diffuser surface 446 and the diffuser groove 446*a* may be formed to be bent at a position corresponding to the bending portion 440*b*.

The upper edge 445 may horizontally extend. When the upper edge 445 horizontally extends, the upper edge 445 effectively guides upward air discharged through the fans 500, 600, and 700, so ascending airflow may be formed.

The lower edge 444 may be formed in a curved surface shape. The lower edge 444 may be formed in a curved surface shape formed to be concavely upward from the lower side. The lower edge 444 may be formed to be concave toward the upper edge 445. The shape of the lower edge 444 may be an arc shape. The lower edge 444 may form a concave lower end of the diffuser 440.

The lower edge 444 may connect the outer edge 441 and the inner edge 442. Both ends of the lower edge 444 that are connected to the outer edge 441 and the inner edge 442, respectively, may be positioned at the same height.

When the lower edge 444 is formed in a straight surface shape, in comparison to a curved surface shape, relatively large flow resistance is generated in the air discharged from the fans 500, 600, and 700, and blowing performance is reduced and noise is generated by the generated flow resistance.

By forming the lower edge 444 in an arc shape, it is possible to minimize flow resistance acting in the air discharged from the fans 500, 600, and 700, and it is possible to reduce operation noise.

By forming the lower edge 444 in an arc shape, it is possible to increase the air volume and air pressure of air that is supplied to the first tower 220 and the second tower 230.

The length between the upper edge 443 and the lower edge 444 is defined as a first diffuser length DL1.

A maximum spacing length between a virtual horizontal line, which connecting a first lower point 441*a* constituting the lowermost side of the outer edge 441 and a second lower point 442*a* constituting the lowermost side of the inner edge 442, and the lower edge 444 is defined as a second diffuser length DL2.

The second diffuser length DL2 may be formed as 10% to 30% of the first diffuser length DL1. The first diffuser length DL1 may be 25 mm and the second diffuser length DL2 may be 5 mm that is 20% of the first diffuser length DL1.

The diffuser 440 may be formed to be curved in the up-down direction. The diffuser 440 may include: a first extending portion 440*a* extending downward from the upper edge 443; a second extending portion 440*c* extending upward from the lower edge 444; and a bending portion 440*b* connecting the first extending portion 440*a* and the second extending portion 440*c*.

The first diffuser surface 445 may extend to have distribution of a radius of curvature that is continuous in the up-down direction. The second diffuser surface 446 may extend to have distribution of a radius of curvature that is discontinuous in the up-down direction, and the radius of curvature may be discontinuous at the bending portion 440*b*.

The lower edge 444 may be formed lower than the bending portion 440*b* and may have an arc shape under the bending portion 440*b*.

The up-down gap between the first lower point 441*a* and the bending portion 440*b* may be larger than the second diffuser length DL2. The up-down gap between the second lower point 442*a* and the bending portion 440*b* may be larger than the second diffuser length DL2.

Figure 26A:
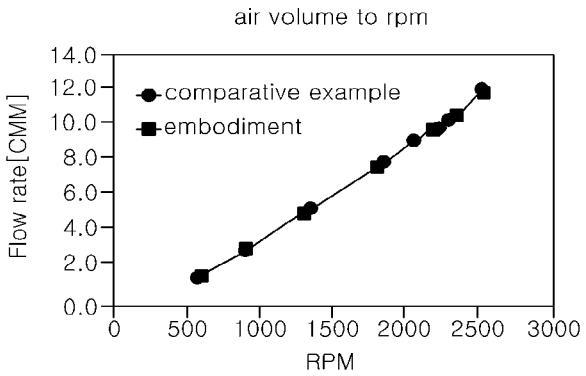
FIGS. 26A-26B are graphs showing an effect against an air volume and noise of the diffuser according to an embodiment of the present disclosure.
Figure 26B:
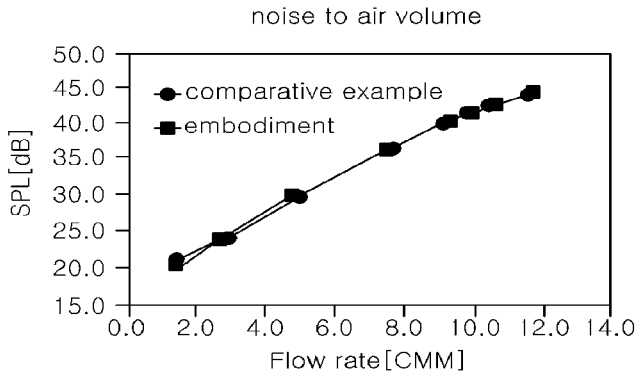

Hereafter, an operation effect of the diffuser 440 on an air volume and noise is described with reference to FIGS. 26 and 27. FIG. 26(*a*) is a graph comparing an air volume with an RPM in a comparative example, FIG. 26(*b*) is a graph comparing an air volume with noise in a comparative example, FIG. 27(*a*) is a graph showing noise according to a frequency in a comparative example, and FIG. 27(*b*) is a graph showing noise according to a frequency in an embodiment of the present disclosure.

In the lower end shape of a diffuser is horizontally formed in a comparison target fan, and the shape of the lower edge 444 of the diffuser 440 is an arc shape in a fan according to the embodiment.

Referring to FIG. 26(*a*) it can be seen that as the number of revolutions of the fan increases, the air volume increases, and there is little different between the comparison target and the embodiment.

Referring to FIG. 26(*b*) and Table 4, it can be seen that as the air volume of the fan increases, noise increases, and it can be seen that when the same air volume is given, the diffuser according to the embodiment reduces noise by 0.1 dB in comparison to the comparison target.

TABLE 4

| | RPM(@10 CMM) | dB(@10 CMM) | Primary BPF | Third BPF |
|---|---|---|---|---|
| Diffuser of related art | 2247 | 42.1 | 29.1 | 26.6 |
| Arc-shaped diffuser | 2247 | 42.0(↓0.1 dB) | 26.5 | 26.6 |

Figure 27A:
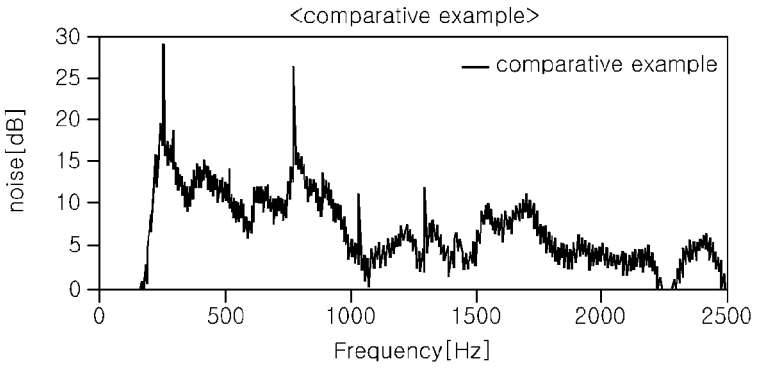
FIGS. 27A-27B are graphs showing an effect against an air volume and noise of the diffuser according to an embodiment of the present disclosure.
Figure 27B:
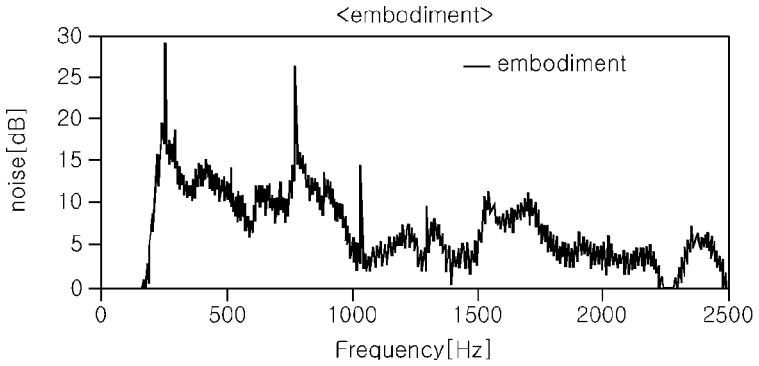

FIG. 27(*a*) is a noise graph according to a diffuser having a flat lower end in the related art FIG. 27(*b*) is a noise graph according to a diffuser having an arc-shaped lower end as in an embodiment of the present disclosure. BPF (Blade Passing Frequency) is a blade passing frequency and is peaking noise that is harmonically generated at specific frequencies in rotation. BPF is a general technique for those skilled in the art, so detailed description is omitted.

Referring to FIG. 27(*b*) and Table 4, the diffuser according to the embodiment can reduce noise of 2.6 dB in comparison to the comparison target at the primary BPF.

Although exemplary embodiments of the present disclosure were illustrated and described above, the present disclosure is not limited to the specific exemplary embodiments and may be modified in various ways by those skilled in the art without departing from the scope of the present disclosure described in claims, and the modified examples should not be construed independently from the spirit of the scope of the present disclosure.

The invention claimed is:

1. A blower, comprising:

a lower case in which a suction hole through which air flows into the blower is formed;

an upper case that is disposed on the lower case and in which a discharge hole through which air is discharged out of the blower is formed;

a fan motor that provides a rotational force; and a fan that is disposed in the lower case and is fixed to a motor shaft of the fan motor, wherein the fan includes:

a hub having an outer surface that extends at an incline at a first angle with respect to the motor shaft;

a plurality of blades coupled to the hub; and a shroud that extends at an incline at a second angle, which is larger than the first angle, with respect to the motor shaft, and having an inner surface facing the outer surface of the hub with the plurality of blades therebetween, wherein an outer end of the outer surface of the hub in a radial direction and an inner end of the shroud in the radial direction are aligned along a line that extends parallel to the motor shaft.

2. The blower of claim 1, wherein the hub forms a hub upper end by extending outward in the radial direction, wherein the shroud forms a shroud edge by extending outward in the radial direction, and wherein the shroud edge is positioned outside of the hub upper end in the radial direction.

3. The blower of claim 1, wherein the shroud includes:

a rim portion that extends in a circumferential direction; and a supporting portion that extends outward in the radial direction from the rim portion, and wherein the rim portion is positioned outside of a hub upper portion in the radial direction formed by extending the hub outward in the radial direction.

4. The blower of claim 1, wherein the hub includes:

a shaft coupling portion that protrudes upward and downward at a center of the hub and in which the motor shaft is inserted;

a first guide surface that extends horizontally outward from the shaft coupling portion; and a second guide surface that extends at an incline upward from an outer end of the first inclined surface.

5. The blower of claim 4, wherein the shaft coupling portion forms a hub lower end by protruding downward from the center of the hub and forms a hub protruding portion by protruding upward, and wherein the shroud has a shroud edge formed at a height between the hub lower end and the hub protruding portion.

6. The blower of claim 4, wherein the shroud has a shroud edge positioned at a height between a hub lower end formed by the shaft coupling portion protruding downward from the center of the hub and the first guide surface.

7. The blower of claim 4, wherein the shroud includes a rim portion that extends in a circumferential direction, a supporting portion that extends outward from the rim portion, and a rim portion upper end that connects the rim portion and the supporting portion, and wherein the shaft coupling portion is positioned higher than the rim portion upper end.

8. The blower of claim 1, wherein an inclination angle of the shroud with respect to a horizontal surface is formed in a range of 35 degrees to 50 degrees.

9. The blower of claim 1, wherein an expansion angle is formed between the hub and the shroud.

10. The blower of claim 9, wherein the expansion angle is formed within a range of 11 degrees and 26 degrees.

11. A blower, comprising:

a lower case in which a suction hole through which air flows into the blower is formed;

an upper case that is disposed on the lower case and in which a discharge hole through which air is discharged from the blower is formed;

a fan that is disposed in the lower case and has a plurality of blades; and a diffuser that is disposed at a downstream side of the fan and extends in an upward-downward direction, wherein the diffuser includes a lower end that is concave upward such that a length between the lower end and an upper end at a middle portion of the diffuser in a radial direction is smaller than at an outer edge or an inner edge of the diffuser in the radial direction.

12. The blower of claim 11, further comprising:

a fan housing in which the fan is accommodated; and a motor housing in which a fan motor that applies power to the fan is accommodated, wherein the diffuser is disposed between the fan housing and the motor housing.

13. The blower of claim 11, wherein the diffuser extends to be curved in the upward-downward direction.

14. The blower of claim 11, wherein the diffuser includes:

a first extending portion that extends to be curved downward from an upper end;

a second portion extending that extends upward from the lower end; and a bending portion that connects the first extending portion and the second extending portion.

15. The blower of claim 11, wherein the fan includes a hub in which a motor shaft of a fan motor is inserted and a shroud that is disposed to be spaced under the hub, and wherein at least a portion of the diffuser is positioned between the hub and the shroud in the radial direction.

16. The blower of claim 11, wherein a height of a lower end formed to be concave from an upper side is formed within a range of 10% to 30% of an entire height of the diffuser.

17. The blower of claim 11, wherein the diffuser includes a plurality of diffuser grooves that extends in the upward-downward direction and spaced apart from each other in an extension direction of the lower end, and a rib is formed between the plurality of diffuser grooves.

18. The blower of claim 17, wherein groove lower ends of the plurality of diffuser grooves are formed to come in contact with a lower end of the diffuser.

19. The blower of claim 17, wherein groove upper ends of the plurality of diffuser grooves are formed to be spaced apart from an upper end of the diffuser.

20. The blower of claim 17, wherein groove upper ends of the plurality of diffuser grooves are positioned on a singular horizontal surface.

* * * * *